US006618998B1

(12) United States Patent
Thomas et al.

(10) Patent No.: US 6,618,998 B1
(45) Date of Patent: Sep. 16, 2003

(54) DOOR WITH VARIABLE LENGTH SCREEN

(75) Inventors: Bruce E. Thomas, Brookings, SD (US); Kelly D. Nordgaard, Gary, SD (US); Bryan P. Zacher, Brookings, SD (US); Alan M. Dixon, Brookings, SD (US); Allen E. Lee, Brookings, SD (US)

(73) Assignee: Larson Manufacturing Company, Brookings, SD (US)

( * ) Notice: Subject to any disclaimer, the term of this patent is extended or adjusted under 35 U.S.C. 154(b) by 0 days.

(21) Appl. No.: 10/212,465

(22) Filed: Aug. 5, 2002

Related U.S. Application Data

(60) Provisional application No. 60/310,557, filed on Aug. 7, 2001.

(51) Int. Cl.[7] ..... E06B 9/52

(52) U.S. Cl. ..... 52/63; 52/455; 160/100

(58) Field of Search ..... 160/27, 28, 99, 160/100; 52/63, 455

(56) References Cited

U.S. PATENT DOCUMENTS

| | | | |
|---|---|---|---|
| 375,000 | A | 12/1887 | Roger |
| 510,336 | A | 12/1893 | Felthousen |
| 700,956 | A | 5/1902 | Lorenz |
| 729,630 | A | 6/1903 | Milans |
| 772,686 | A | 10/1904 | Ullner |
| 782,743 | A | 2/1905 | Fischer |
| 808,400 | A | 12/1905 | Parsons |
| 975,146 | A | 11/1910 | Manelius |
| 998,006 | A | 7/1911 | Hutchison |
| 1,015,143 | A | 1/1912 | Wood |
| 1,020,601 | A | 3/1912 | Hamilton |
| 1,022,547 | A | 4/1912 | Hansen |
| 1,036,721 | A | 8/1912 | Rockwell |
| 1,038,138 | A | 9/1912 | Hikes |
| 1,063,830 | A | 6/1913 | Rader |
| 1,088,139 | A | 2/1914 | Fischer |
| 1,100,564 | A | 6/1914 | Heryford |
| 1,141,996 | A | 6/1915 | Vanasdale |
| 1,143,863 | A | 6/1915 | Schenk |
| 1,150,000 | A | 8/1915 | Matthews |
| 1,168,155 | A | 1/1916 | Broune |
| 1,172,800 | A | 2/1916 | Johnson |
| 1,184,305 | A | 5/1916 | Benko |
| 1,192,406 | A | 7/1916 | Fair |
| 1,207,885 | A | 12/1916 | Estabrook |
| 1,219,817 | A | 3/1917 | Gemeny et al. |
| 1,240,768 | A | 9/1917 | O'Neill |
| 1,241,425 | A | 9/1917 | Nelson |
| 1,283,918 | A | 11/1918 | Romuender |
| 1,317,579 | A | 9/1919 | Johnson |
| 1,338,223 | A | 4/1920 | Heath |
| 1,370,500 | A | 3/1921 | Jones |

(List continued on next page.)

OTHER PUBLICATIONS

Reddiplex Group PLC, Meshlock data sheet, prior to Aug. 5, 2002, England.

Phantom MFG., Design Specifications Retractable Screens, Published Nov., 1999, Canada.

Eclipse Technologies, Eclipse Retractable Screens, prior to Aug. 5, 2002, Canada.

AGIgroup, Screen–Time.com, Roll Screens, copyright 1999–2000, United States of America.

*Primary Examiner*—Carl D. Friedman
*Assistant Examiner*—Basil Katcheves
(74) *Attorney, Agent, or Firm*—Welsh & Katz, Ltd.

(57) ABSTRACT

An exterior door incorporates at least one moving glass insert or sash slidable in first and second spaced apart tracks. An end of the insert is coupled to an end of a spring biased rolled screen. As the insert moves from the roll, the screen is extracted therefrom providing a continuously variable screened region in the door. The insert can be positioned using a counterbalance or spaced apart latchable locations in the door.

22 Claims, 15 Drawing Sheets

U.S. PATENT DOCUMENTS 1,414,583 A 5/1922 Rothstein
1,462,644 A 7/1923 Lancaster
1,481,615 A 1/1924 Meyer
1,487,926 A 3/1924 Evans
1,583,133 A 5/1926 Fierman
1,662,117 A 3/1928 Kuhl
1,734,415 A 11/1929 Bierfield
1,844,599 A 2/1932 Renzetti
1,871,141 A 8/1932 Baker et al.
1,873,156 A 8/1932 Seide
1,878,710 A 9/1932 Watson
1,880,589 A 10/1932 Traut
1,885,756 A 11/1932 Norquist et al.
1,934,103 A 11/1933 Traut
1,942,308 A 1/1934 Renzetti
1,958,695 A 5/1934 Claus
1,971,451 A 8/1934 Helfmann
1,987,488 A 1/1935 Morelli
2,015,993 A 10/1935 Drake
2,107,755 A 2/1938 Kemp
2,131,521 A 9/1938 Nye
2,221,515 A 11/1940 Goldenberg
2,225,050 A 12/1940 Herzog
2,293,968 A 8/1942 Chandler et al.
2,336,530 A 12/1943 Chandler et al.
2,352,609 A 7/1944 Bates
2,365,454 A 12/1944 Chandler et al.
2,379,120 A * 6/1945 Turner ..... 160/27
2,386,016 A * 10/1945 Turner ..... 160/100
2,388,044 A 10/1945 Drab
2,514,274 A 7/1950 Zagrodny
2,575,128 A 11/1951 Renzetti
2,615,513 A 10/1952 Radford
3,024,837 A * 3/1962 McPhail ..... 160/91
3,105,542 A 10/1963 Lynch
3,116,097 A 12/1963 Novales
3,179,161 A 4/1965 Johnson
3,398,779 A 8/1968 Kuss
3,414,039 A 12/1968 King
3,425,165 A 2/1969 Cleveland
3,448,943 A 6/1969 Herou
3,489,199 A 1/1970 Weikel et al.
3,489,200 A 1/1970 Recchione
3,842,890 A 10/1974 Kramer
3,891,020 A 6/1975 Mennuto
3,911,990 A 10/1975 Hoover et al.
4,001,972 A 1/1977 Hurwitz
4,006,770 A 2/1977 Ferguson
4,009,745 A 3/1977 Erpenbeck
4,027,431 A 6/1977 Rackard
4,028,849 A 6/1977 Anderson
4,197,896 A 4/1980 Reichstadt
4,261,524 A 4/1981 Ludenbach
4,297,812 A * 11/1981 McPhail ..... 49/386
4,311,183 A 1/1982 Herbst et al.
4,344,255 A 8/1982 Knoll
4,359,081 A 11/1982 Brower
4,390,054 A 6/1983 Niibori et al.
4,458,739 A 7/1984 Murray et al.
4,467,853 A 8/1984 Downey, Jr.
4,480,676 A 11/1984 Solomon
4,506,478 A 3/1985 Anderson
4,586,291 A 5/1986 Swan
4,599,833 A 7/1986 Bullock
4,638,844 A 1/1987 Hayashiguchi
4,649,981 A 3/1987 Bibeau
4,651,797 A 3/1987 Lange
4,651,940 A 3/1987 Nakamura
4,658,879 A 4/1987 Klompenburg
4,667,441 A 5/1987 Coddens
4,671,557 A 6/1987 Lemp
4,685,175 A 8/1987 Yonovich
4,702,297 A 10/1987 Klompenburg
4,741,488 A 5/1988 Futagawa
4,757,852 A 7/1988 Jentof et al.
4,819,295 A 4/1989 Kaftan
4,821,786 A 4/1989 Johnston
4,825,921 A 5/1989 Rigter
4,834,160 A 5/1989 Becker
4,846,241 A 7/1989 Chomka et al.
4,922,658 A 5/1990 Coddens
4,935,987 A 6/1990 Sterner, Jr.
4,961,247 A 10/1990 Leitzel et al.
4,993,468 A 2/1991 Hackman et al.
4,999,948 A 3/1991 Hodgens
5,012,616 A 5/1991 Martin
5,035,081 A 7/1991 Yamamoto
5,044,417 A 9/1991 Bresson
5,099,905 A 3/1992 Rigter
5,119,591 A 6/1992 Sterner, Jr. et al.
5,265,308 A 11/1993 May et al.
5,392,835 A 2/1995 Wildt
5,505,244 A 4/1996 Thumann
5,544,689 A 8/1996 Wegner
5,634,508 A 6/1997 Herbst
5,682,710 A 11/1997 Davies et al.
5,687,506 A 11/1997 Davies et al.
5,794,678 A 8/1998 Beringer et al.
5,803,145 A 9/1998 Lamb
5,887,391 A 3/1999 Shoup
5,901,768 A * 5/1999 Herbst ..... 160/90
5,946,857 A 9/1999 Davies et al.
6,068,802 A * 5/2000 Berghorn et al. ..... 264/46.5
6,082,432 A 7/2000 Kissinger
6,167,936 B1 * 1/2001 Stover et al. ..... 160/27
6,256,931 B1 * 7/2001 Kenkel et al. ..... 49/450
6,446,696 B1 9/2002 Davies et al.

* cited by examiner

DOOR WITH VARIABLE LENGTH SCREEN

This application is a utility application claiming the benefit of the earlier filing date of provisional application Ser. No. 60/310,557 filed Aug. 7, 2001.

FIELD OF THE INVENTION

The invention pertains to doors. More particularly, the invention pertains to doors having at least one slidable glass pane or panel with an extendable screen attached thereto.

BACKGROUND OF THE INVENTION

Storm doors which incorporate panes of glass and screens are known. Some forms of such doors include screens which are fixedly mounted to the frame of the door with sliding glass inserts. With these doors, the inserts usually can be locked into a plurality of vertical positions with spring loaded latches to expose varying degrees of screen. When the inserts are moved to their fully close position, such as during storms or in cold weather, a person looking at the door, must look through at least one pane of glass and the screen.

In other forms of doors, glass inserts or screen inserts are installed on the doors' frame depending on the season. In warmer weather the glass insert is removed and a screen insert is used in the frame. In cooler weather, the screen is removed and a glass insert is attached to the frame. With such doors, an individual looking at the door looks through either a pane of glass or a screen but not both.

One known door configuration provides a fixed screen with a counterbalanced insert. In this configuration, the insert is not latched at a selected position on its track. The counterbalance makes it possible to position the insert at any desired position o the track. However, when the insert is in its closed position, a person viewing the door must look through both the glass insert and the screen.

Patio door configurations are known which include sliding glass doors which can be opened or closed to provide access to a patio or a porch. Spring biased screen modules are known which can be attached to the patio door frame. These modules include horizontally retractable screens which can be extended across a patio door opening to exclude insects or other flying pests.

While the known doors are generally suitable for their intended purpose, they all suffer from one or more deficiencies in performance, convenience and ease of use. There continues to be a need for multi-season doors which provide convenient and easy to use screened openings during warmer drier weather while at the same time making it possible to easily close the screened area with a glass pane during cooler or wetter weather. Preferably such doors could be manufactured, at least in part, using techniques for manufacturing existing doors so as to benefit from the economies of scale that such manufacturing capabilities provide. Additionally, it would be preferable if such doors were easy to maintain and designed to be forgiving in the event that the screen is in need of replacement.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1B:
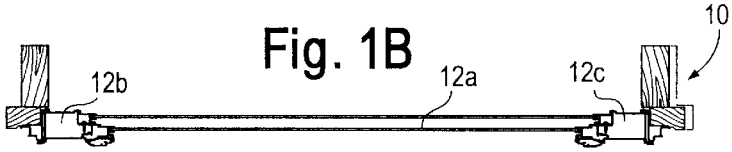
FIG. 1B is a top plan view of the door of FIG. 1A.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

In one embodiment of the invention, an exterior door incorporates a replaceable screen module which includes an integral, spring biased, retractable screen which is coupled to a movable glass insert in the door. As the insert is moved from the screen, the screen is withdrawn from its retracted position and extends along the frame of the door screening the otherwise open region from which the glass insert has moved. As the window sash or insert moves in the opposite direction toward the screen module, the screen is retracted into the module reducing the ventilation region available in the door.

Figure 1C:
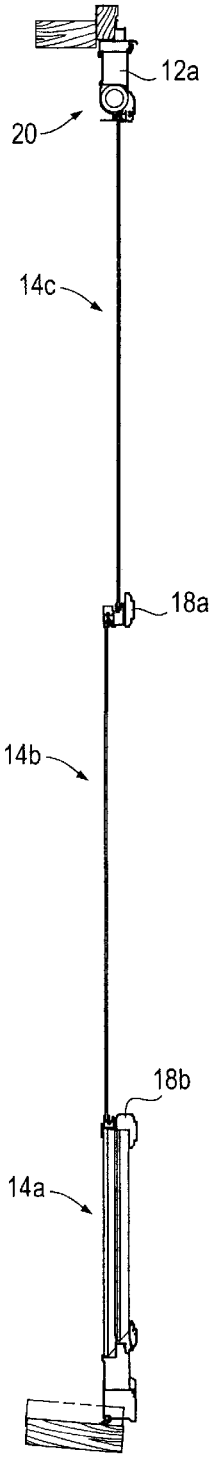
FIG. 1C is a side view of the door of FIG. 1A.
Figure 1A:
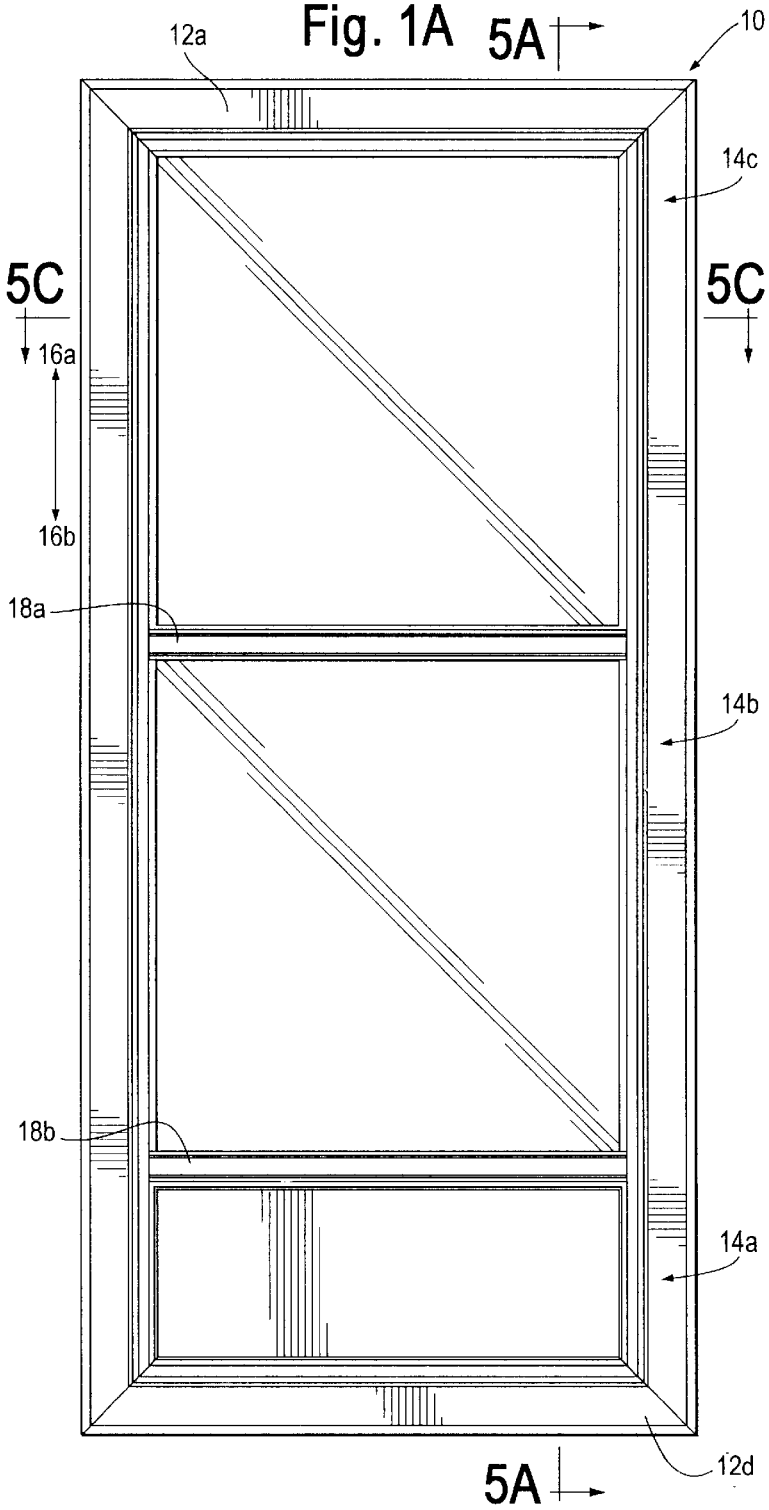
FIG. 1A is a front elevational view of a door in accordance with the present invention.

FIGS. 1A–1C illustrate various views of a door 10 which embodies the present invention. The door 10 includes a header 12*a,* two door jambs 12*b, c* and a sill 12*d.* The members 12*a . . . d* define a door frame with an interior region which in the door 10 includes a kick plate generally indicated at 14*a,* a lower pane or glass insert 14*b,* and an upper pane or glass insert 14*c.* Mullions 18*a, b* on the exterior side of the frame join jambs 12*b, c.*

In the door 10, the pane or insert 14*b* is fixedly mounted between the jambs 12*b, c* and above the kick plate 14*a.* The pane or insert 14*c* is mounted in tracks, discussed in more detail subsequently, for vertical motion generally in directions 16*a, b* relatively to insert 14*b.*

When the insert 14*c* is positioned at its uppermost location adjacent to header 12*a,* the door 10 is fully closed with two glass panes as one would use it in cool or wet weather. The pane or insert 14*c* can be moved, vertically, in direction 16*b,* away from header 12*a* thereby opening the upper portion of door 10 for ventilation.

Figure 7A:
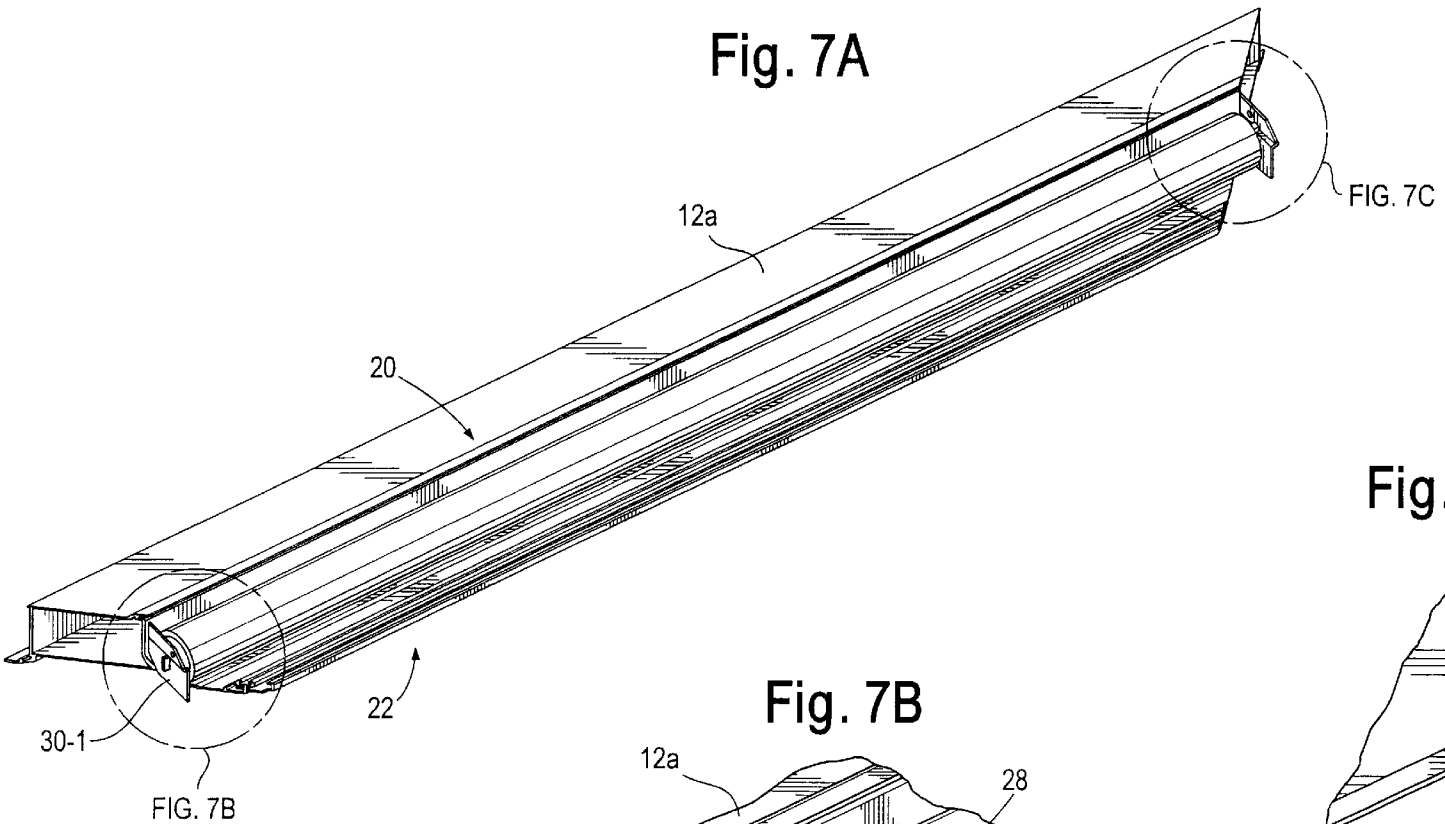
FIGS. 7A–7C illustrate details of a replaceable screen module usable in the door of FIG. 1A.

A screen module 20, best seen in FIG. 7A can be coupled to the jambs 12*b, c,* header 12*a* or sill 12*d.* Module 20 carries a retracted screen which has a free end which carries an attachment member 22 which is coupled to an upper end of insert 14*c.* As the insert 14*c* is moved in the direction 16*b,* screen fabric or material 22-1 from the module 20 is extracted therefrom filling any gap or space between an upper end of insert 14*c* and header 12*a.*

Door 10 can thus, as described above, be converted from a storm door with two glass panes to a screen door simply by moving pane or insert 14*c* vertically downwardly. Where insert 14*c* is moved vertically downwardly to kick plate 14*a,* the extracted screen fills the entire area previously closed by pane 14*c.*

When the insert 14*c* is raised, direction 16*a,* the screen material 22-1 retracts into module 20 for storage. As discussed below, module 20 is removable for maintenance or replacement.

It will be understood that alternate configurations to the door 10 come within the spirit and scope of the present invention. For example, the screen module 20 can be mounted at or near the base 12*d* to provide an openable lower screened region. Alternately, instead of screening material, sheet plastic could be used in the module 20.

Members 12*a*–12*d* of the frame for the door 10 can be formed of metal, such as extruded aluminum, extruded or molded plastic, or partly or completely of a wood product. Inserts 14*b, c* need not include glass but could in fact be closed with translucent or transparent plastic material without departing from the spirit and scope of the present invention.

Figure 2A:
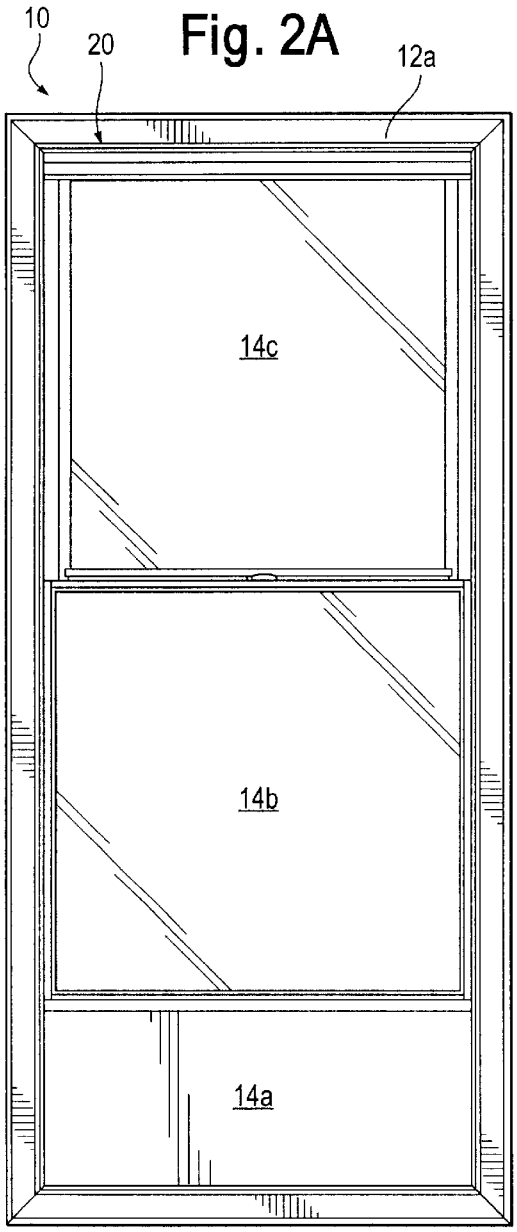
FIG. 2A is a rear elevational view of the door of FIG. 1A.

FIG. 2A is a rear elevational view of the door 10 illustrating the location of screen module 20 adjacent to header 12*a.* Screen module 20 is enclosed by a removable cover 24 which can be removed for purposes of maintenance and for replacing the module 20.

Figure 2B:
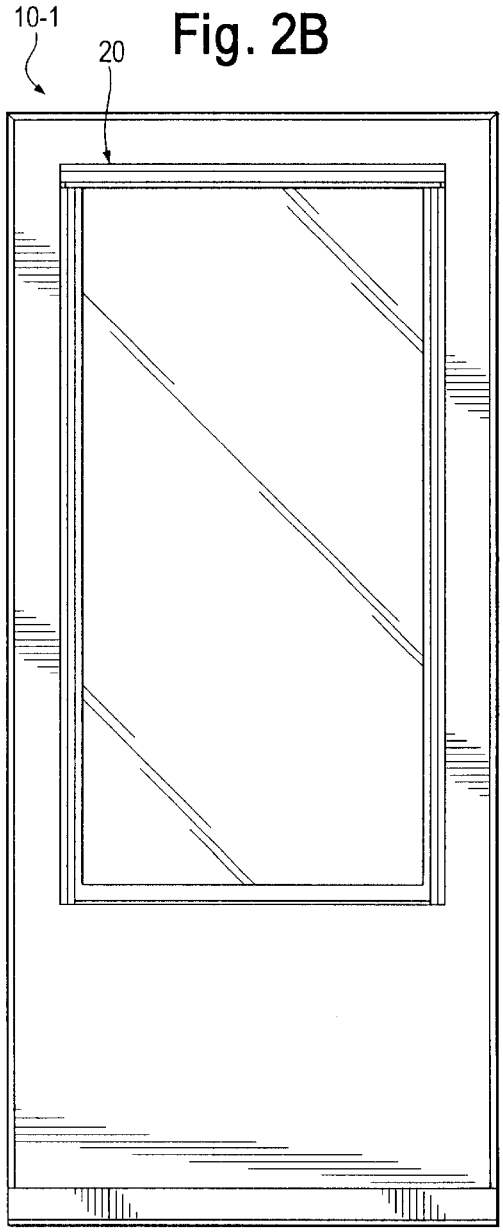
FIG. 2B is a rear elevational view of an alternate door in accordance with the invention.

FIG. 2B illustrates an alternate embodiment, a wood core door 10-1 which incorporates screen module 20. The wood core door 10-1 can be formed with a wood-products core covered with either metal, such as aluminum, or cured resin such as vinyl. It will be understood that the screen module 20 is coupled to a sash or insert, comparable to the insert 14*c,* which moves vertically in tracks, as would be understood by those of skill, in the frame for the door 10-1.

Figure 3B:
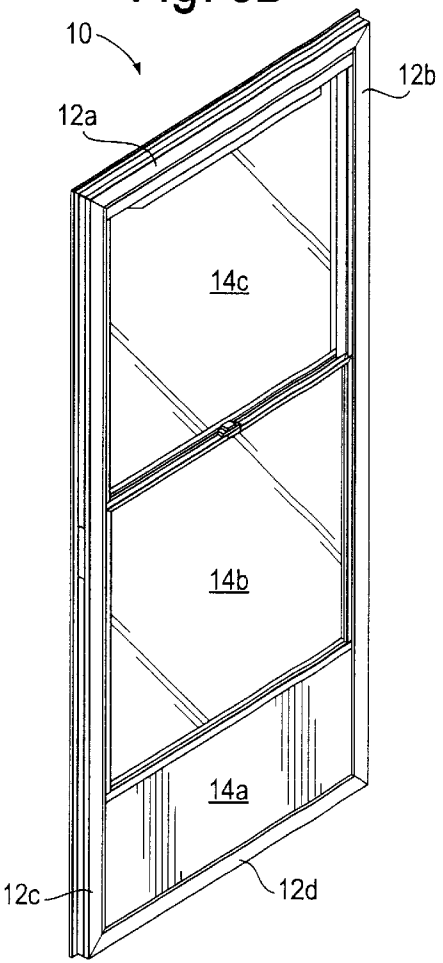
FIG. 3B is a rear isometric view of the door of FIG. 1A.
Figure 3A:
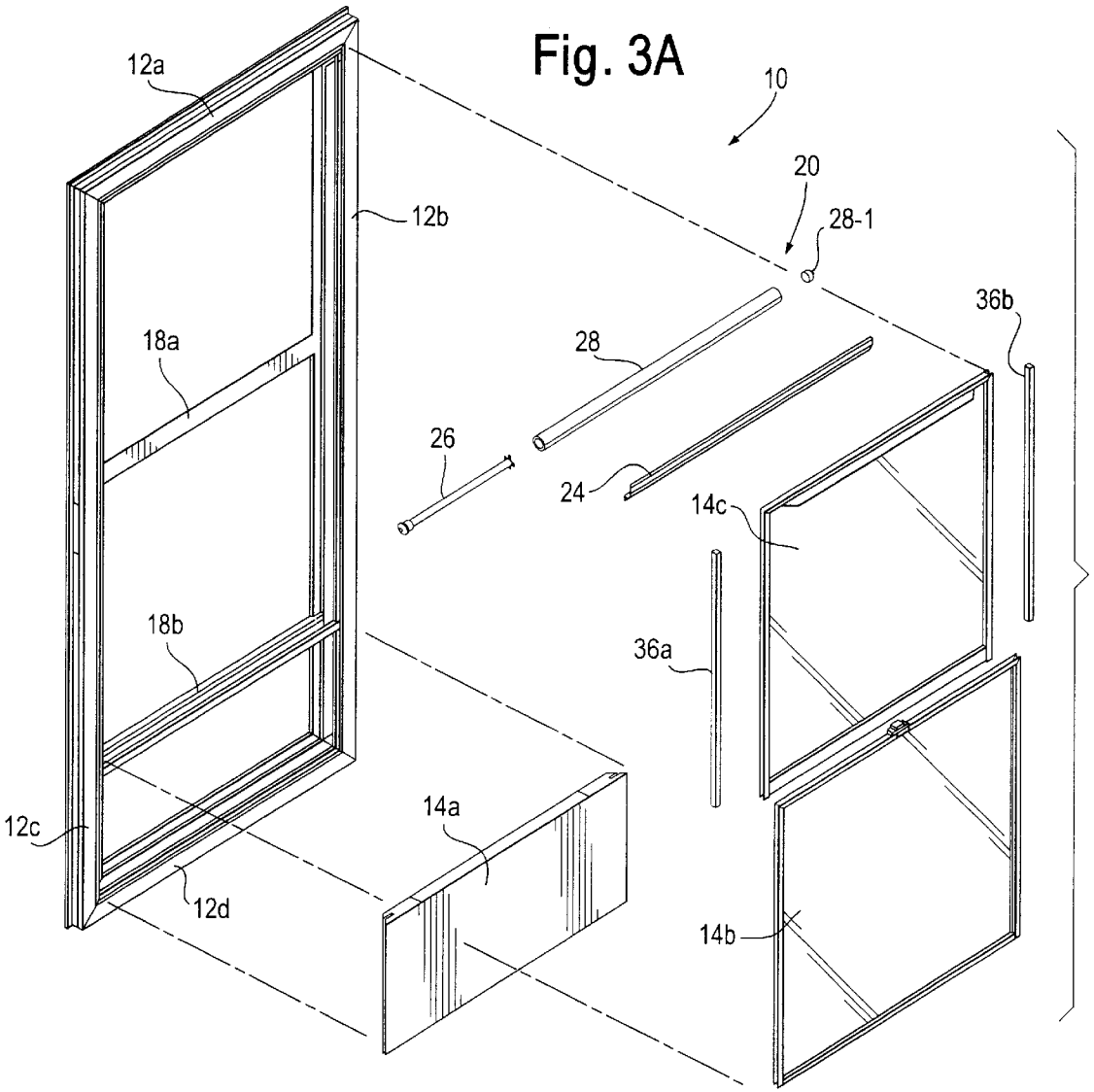
FIG. 3A is an exploded view of the door of FIG. 1A.

FIGS. 3A and 3B are an exploded view of the door 10 and a rear isometric view thereof.

As illustrated in FIG. 3A, module 20 incorporates a spring or retractor assembly 26 which is carried in a hollow screen roll or cylinder 28. The cylinder 28 rotates about retractor assembly 26 and pivot cap 28-1.

Figure 7C:
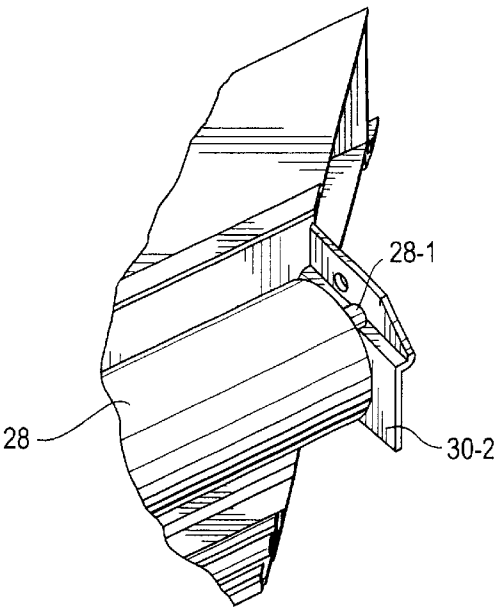
Figure 7B:
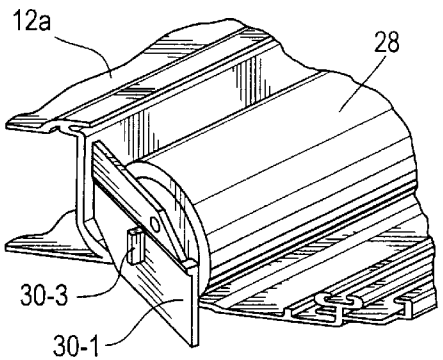

The module 20 is attached to the door so as to permit rotary motion thereof by brackets 30-1 and 30-2, best seen in FIGS. 7A–C. Screen roll 28 carries the coiled screen fabric 22-1 with attached connection member 22, best seen in FIG. 7B.

The spring assembly 26 exerts a substantially constant retracting force on the spring fabric on the roll 28 as the insert 14*c* is moved vertically in directions 16*a, b.* The screen material 22-1 is thus constantly under tension.

The insert 14*c* in door 10, is counterbalanced by counterbalancing mechanisms 36*a, b* carried by the insert 12*a.* The counterbalancing mechanisms 36*a, b* move with the insert 14*a* in the jambs 12*b, c* and are invisible to the user. Types of counterbalances include block and tackle balance, spiral balance and coil spring balance.

The counterbalances 36*a, b* make it possible to smoothly move the insert 14*c* in the direction 16*a, b.* The insert 14*c* can be positioned anywhere along its range of travel and will remain there until moved due to the forces exerted by the counterbalance mechanisms 36*a, b.*

Figure 4B:
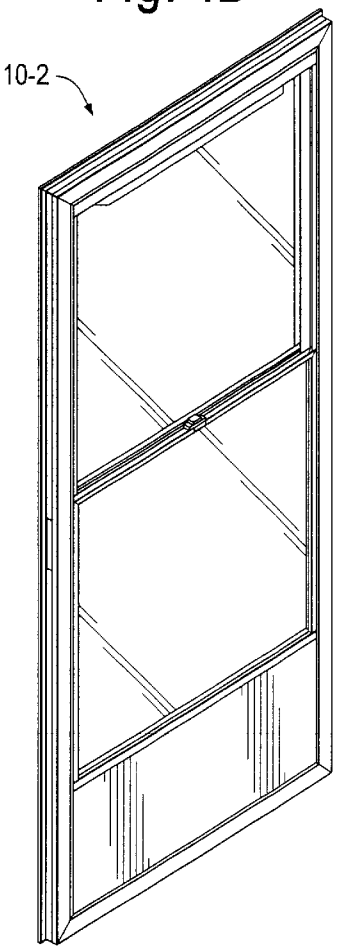
FIG. 4B is a rear isometric view of the door of FIG. 4A.
Figure 4A:
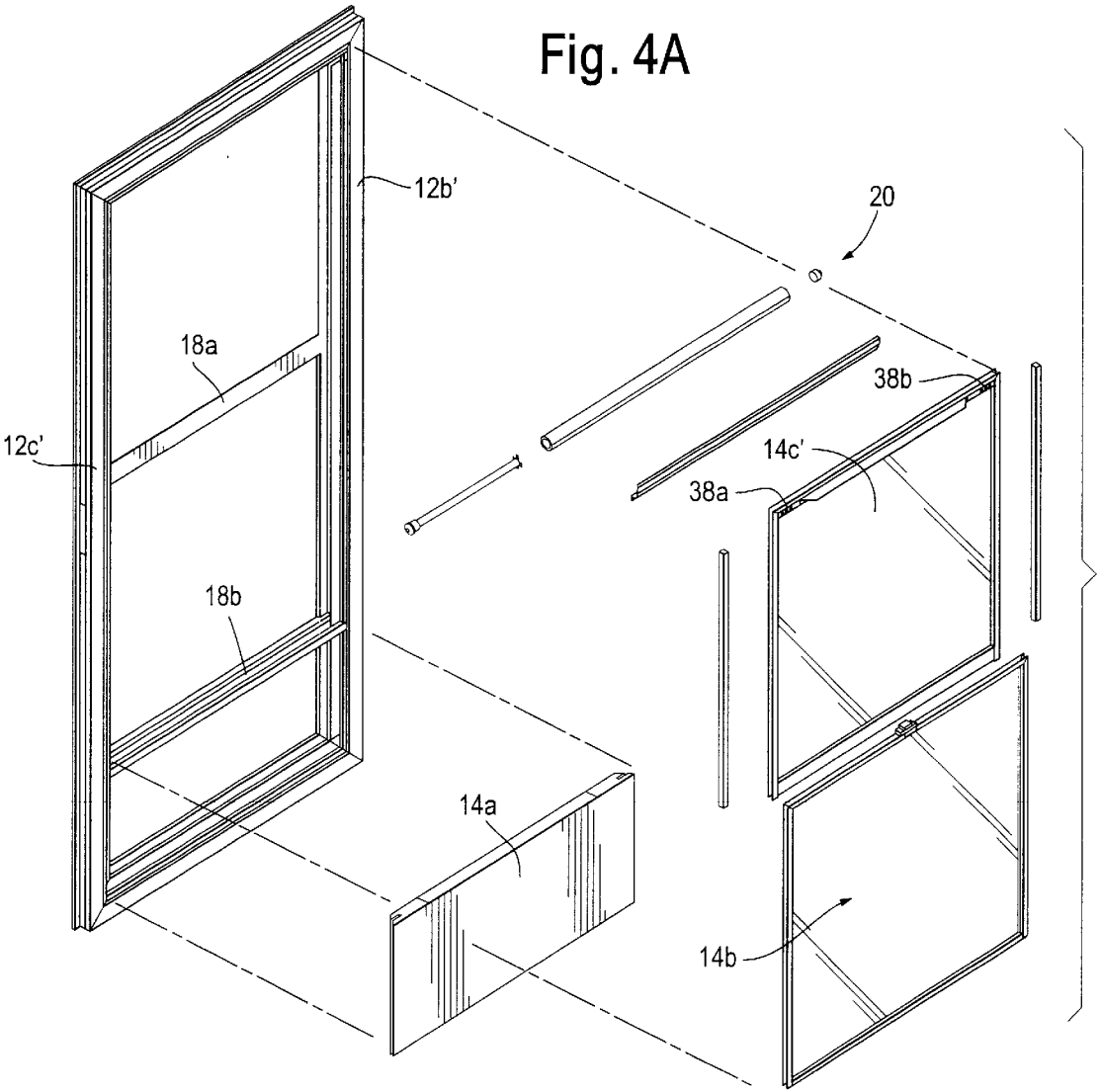
FIG. 4A is an exploded view of an alternate embodiment of the door of FIG. 1A.

FIGS. 4A, B illustrate an alternate embodiment, a door 10-2, which embodies the present invention. Those elements of door 10-2 which correspond to previously discussed elements of the door 10 have been assigned the same identification numerals. As an alternate to the counterbalance mechanisms 36*a, b,* the door 10-2 incorporates spring biased finger operable latches 38*a, b* which are carried by the insert 14*c*'. The latches extend laterally outwardly into slots in the jambs 12*b', c*' to lock the insert 14*c*' into a plurality of spaced apart vertical positions.

In the door 10-2, the insert 14*c*' can be moved vertically to a locking position, the movement will retract the screen 22-1 off of the roll 28 and filling the area of the door frame from which the insert 14*c*' has been moved. The mechanical latches 38*a, b* will lock the insert 14*c*' at the desired degree of openness in the frame of the door 10-2 desired.

In yet another embodiment, insert 14*c* can frictionally engage tracks in jambs 23*b, c.* The frictional forces will support insert 14*c* at any one of a variety of positions. In this embodiment, no counterbalances or latches are needed.

Figure 5A:
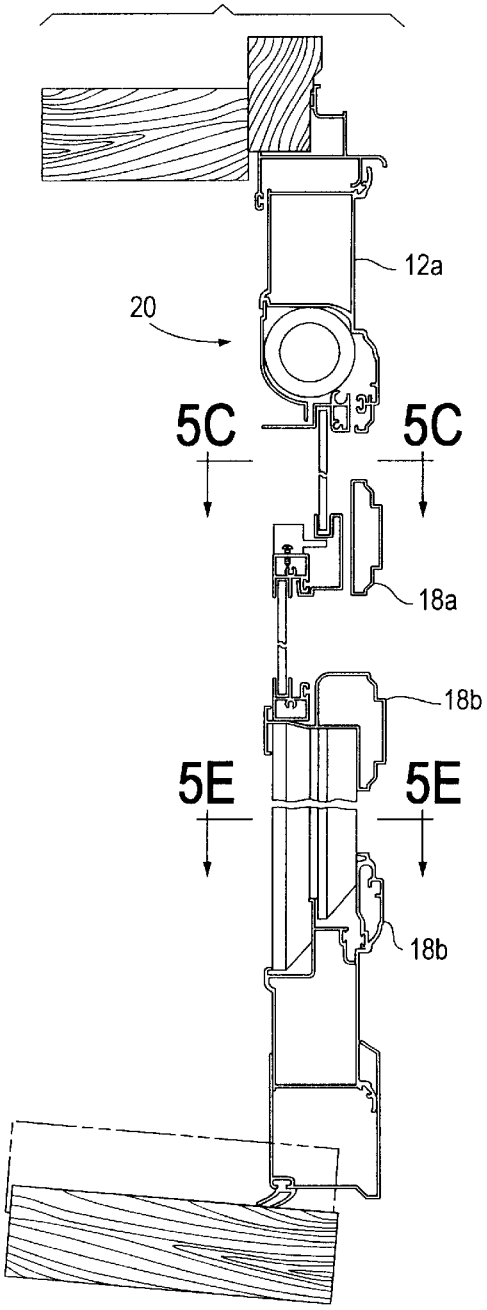
FIGS. 5A and B are side sectional views taken along plane 5A—5A of the door of FIG. 1A.
Figure 5B:
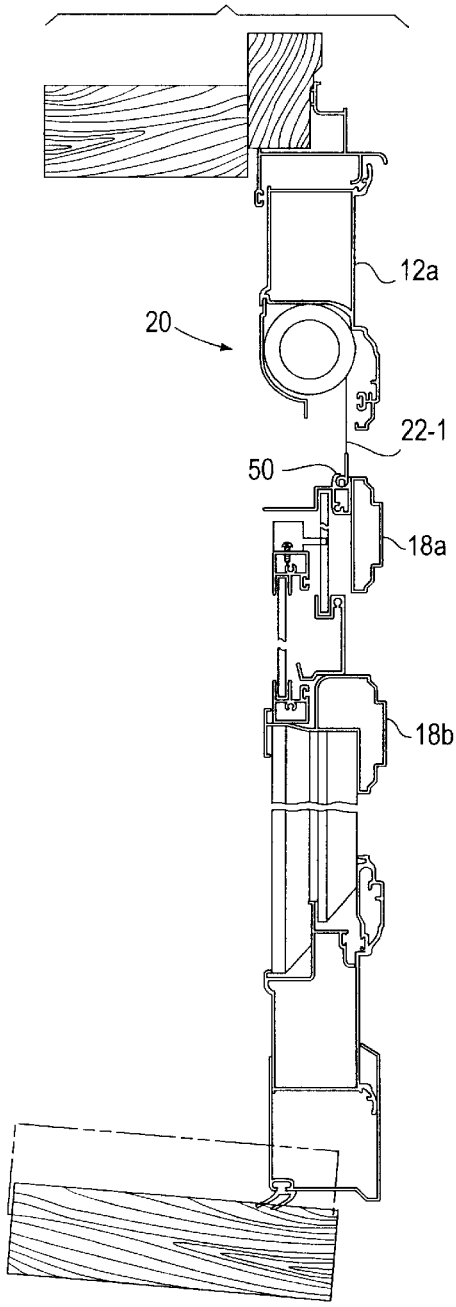
FIG. 5C is a sectional view taken along plane 5C—5C of the door of FIG. 1A.
FIG. 5D is an enlargement of a portion of the section of FIG. 5C.
FIG. 5E is a sectional view taken along plane 5E—5E of FIG. 5A.
FIG. 5F is an enlarged partial view of a portion of the door of FIG. 1A illustrating details thereof.
FIG. 5G is an enlarged partial view illustrating details of an alternate embodiment of the door of FIG. 1A.

FIGS. 5A and 5B are sectional views taken along plane 5A—5A of FIG. 1A. The views of FIGS., 5A, B illustrate the relationship of various structural elements of the door 10 as the insert 14*c* moves from a fully closed position, FIG. 5A, to a partially open position, FIG. 5B. FIG. 5B illustrates the extended screen fabric 22-1.

Figure 5C:
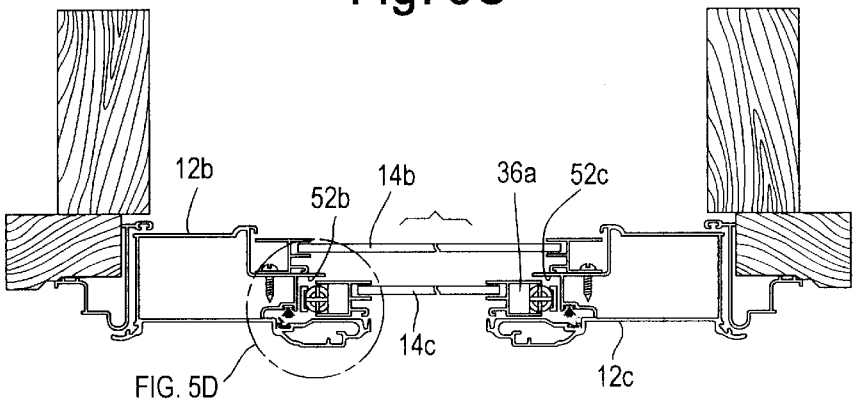

FIG. 5C, a section taken along plane 5C—5C of FIG. 1A illustrates the insert tracks 52*b,* 52*c* which run axially along each of the jambs 12*b, c.* The insert 14*c* moves axially in and is retained within those tracks.

As illustrated in FIG. 5B, the insert 14*c* which is coupled to the screen fabric 22-1 moves axially in tracks 52*b, c* between insert 14*b* and mullion 18*a.* The screen end retaining member 22 is slidably received in a retaining feature 50 located at an upper end of the insert 14*c.*

Edges of the screen fabric 22-1 are confined in axial tracks 54-1, -2. These can be formed in jambs 12*b, c.*

Figure 5D:
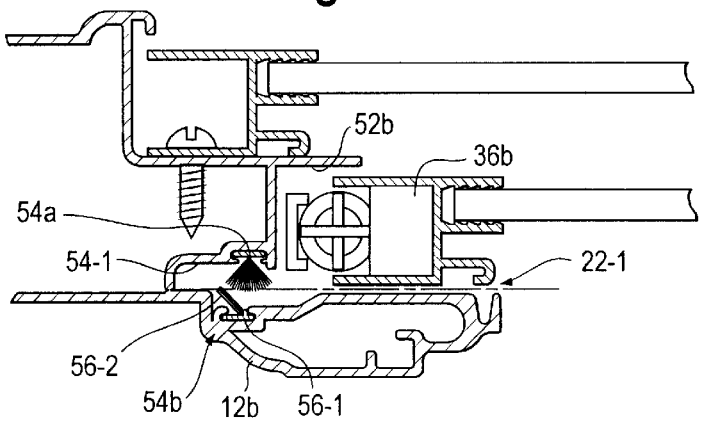
Figure 5E:
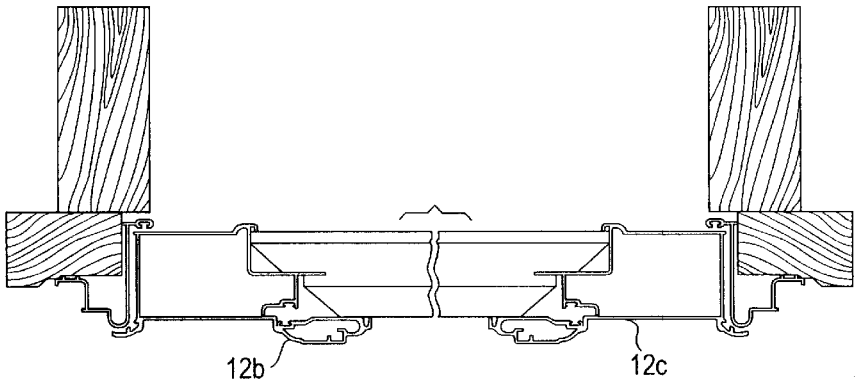

FIG. 5D illustrates the counterbalance mechanism 36*a, b* which is carried by the insert 14*c.* Hence, insert 14*c* can be located at any vertical position on its range of travel as defined by the tracks 52*b,* 52*c* along the jambs 12*b, c.* When so positioned, the screen fabric 22-1, will be extended from the module 20 to the connector feature 50 to close the opening in the frame of the door 10 left by moving the insert 14*c* to a position closer to the kick plate 14*a*.

FIG. 5D also illustrates the screen material 22-1, illustrated in phantom, extended, as in FIG. 5B, extending between first and second weather stripping elements 54*a* and 54*b*. Weather stripping element 54*a* extends axially along the respective jamb 12*b, c* on each side of the door 10. The weather stripping 54*a* can be any form of weather stripping as would be known to those of skill in the art.

The weather stripping 54*b* is different and unlike the weather stripping 54*a*. The weather stripping 54*b* is also positioned in an axially oriented slot which runs along the jambs 12*b, c*.

Weather stripping 54*b* is commercially available from Reddiplex Group PLC, Worchestershire, England under the trade name "MESHLOCK" and is formed with a mounting section 56-1 which slidably engages the respective slot in the jamb 12*b, c*. The mounting section 56-1 carries a deflectable planar element 56-2 which extends from the mounting section 56-1 toward the weather stripping 54*a* at a predetermined angle in a range of 15–75° relative to the plane of the screen.

Figure 5F:
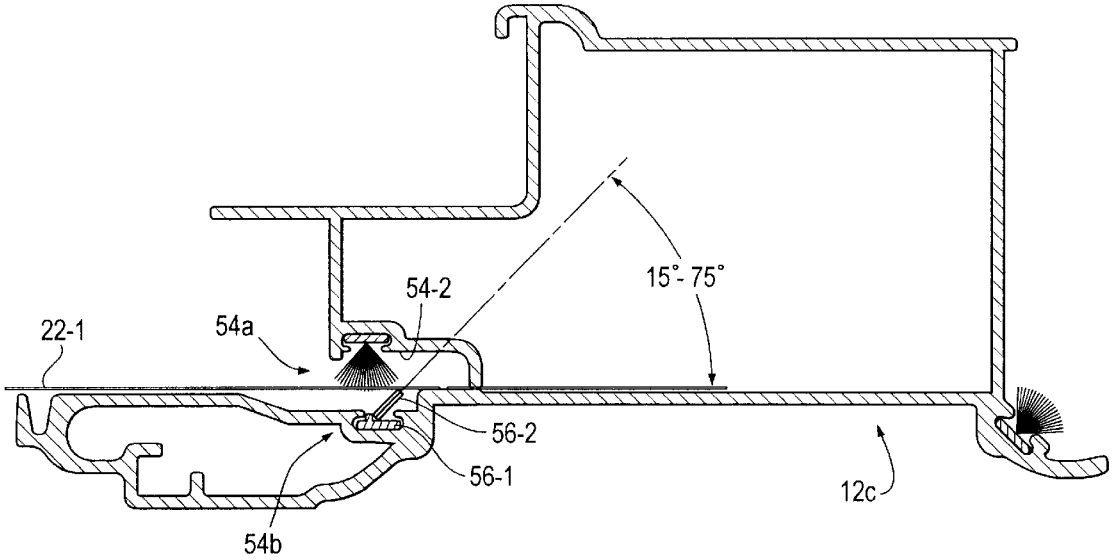

The weather stripping 54*a* acts to press the edge of the screen material 22-1 toward the MESHLOCK-type weather stripping 54*b*, see FIG. 5F. This interaction provides a screen edge retention function. The fibers of the MESHLOCK weather stripping 54*b* resist screen material 22-1 being pulled from between weather stripping 54*a, b*, and the tracks 54-1, -2.

It will be understood that other commercially available forms of weather stripping can be used instead of the MESHLOCK brand without departing from the spirit and scope of the invention.

Figure 5G:
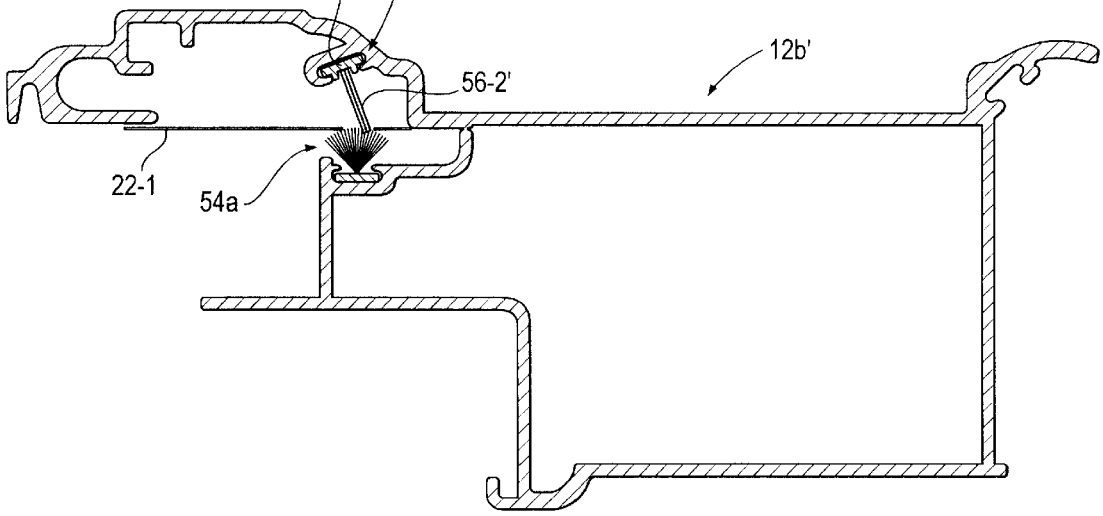

It will be understood that while the MESHLOCK weather strip 54*b* has been illustrated in FIGS. 5D and 5F as exhibiting an acute angle between the mounting section 56-1 and the screen retaining section 56-2, other variations of MESHLOCK weather stripping could be used. Alternately as in FIG. 5C, the members 56-1', -2' could be oriented at 90° to one another. In this embodiment, the track in which the mounting section 56-1' would be located would be oriented at an appropriate angle, best seen in FIG. 5G, relative to the respective jamb 12*b, c* to provide the desired interaction of pressing the screen material 22-1 between the weather stripping 54*a*, 54*b*'.

Figure 6A:
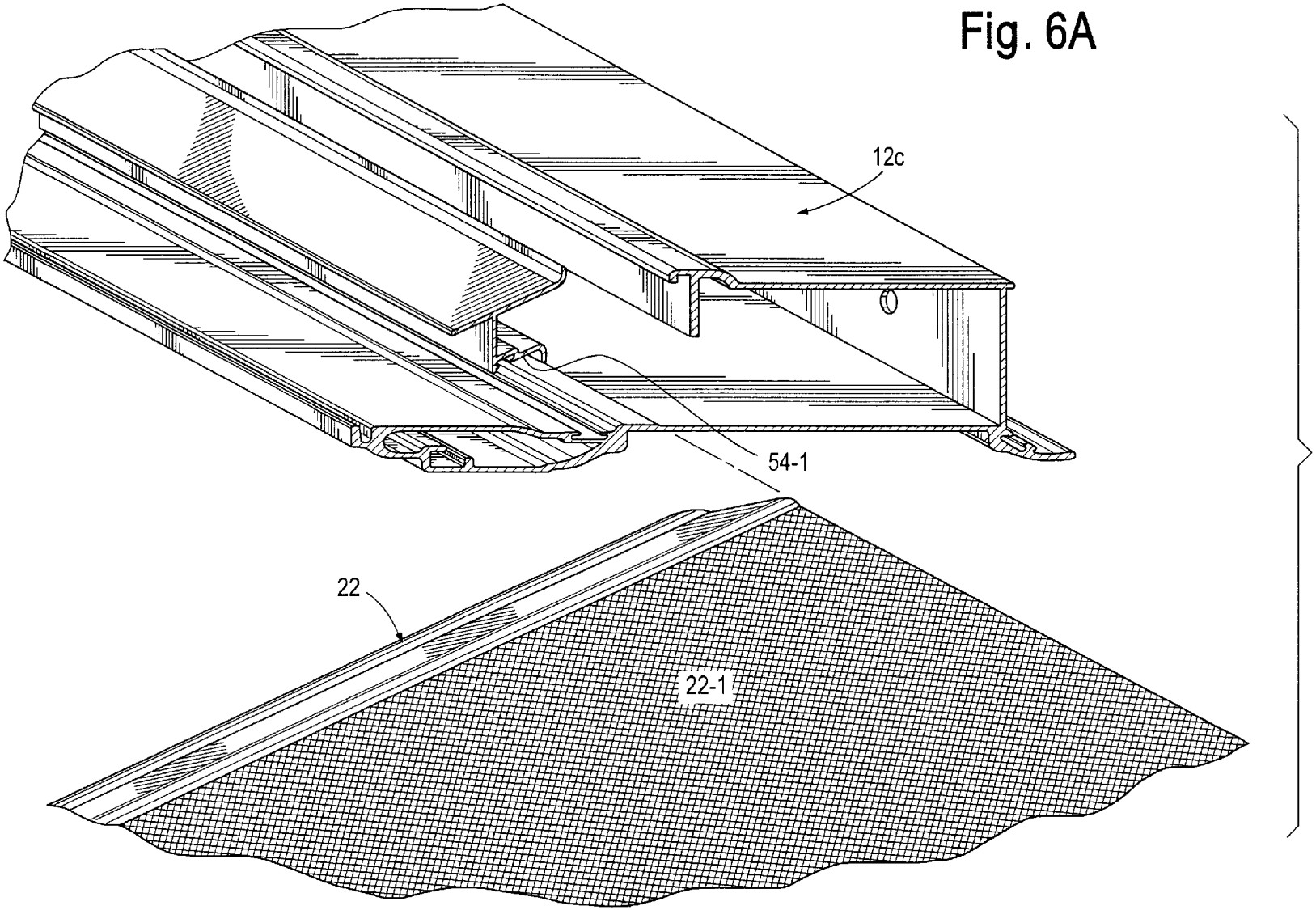
FIGS. 6A, 6B and 6C taken together are isometric views illustrating a process of engaging an extendable screen cloth with the jambs of the door of FIG. 1A.
Figure 6B:
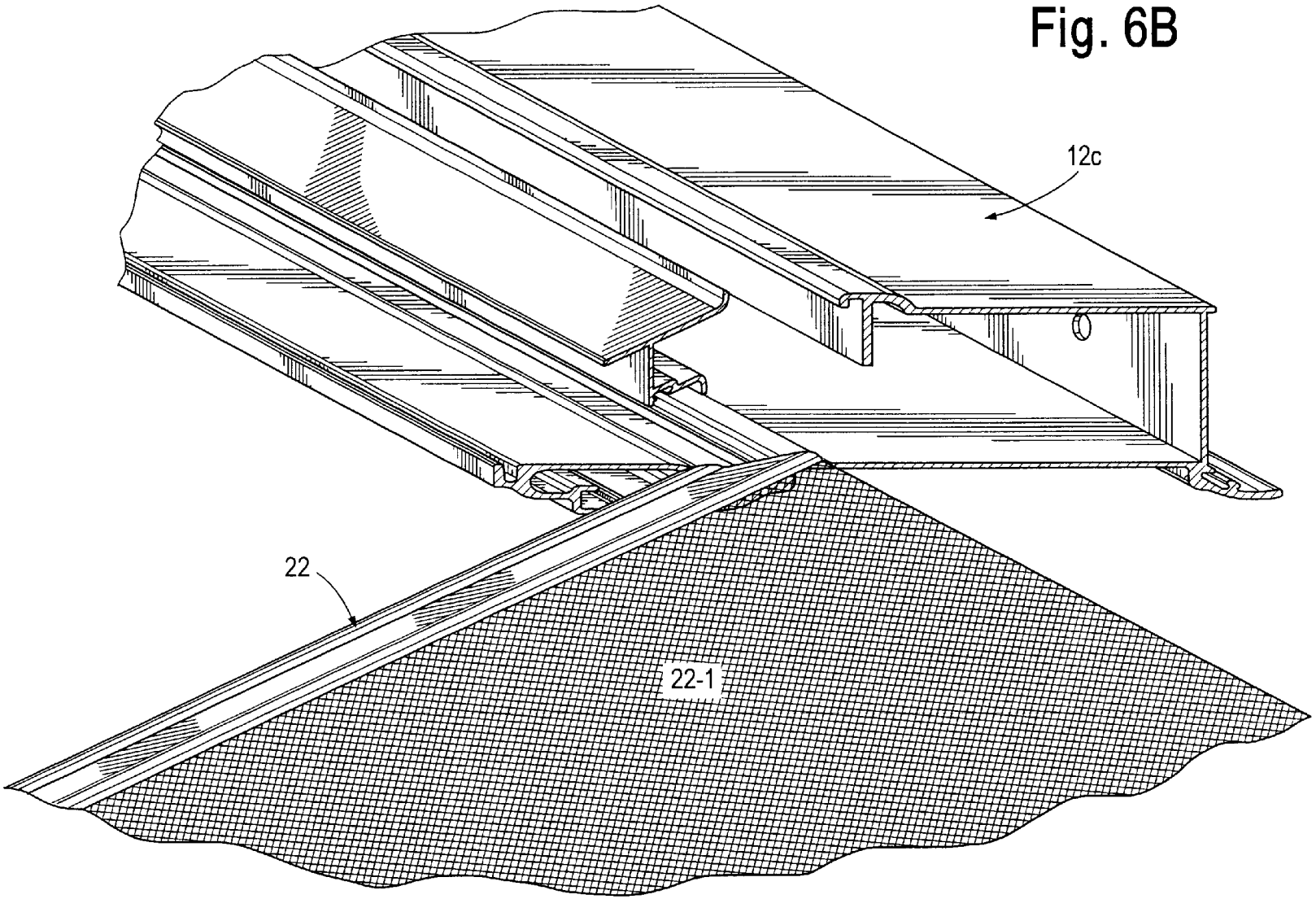
Figure 6C:
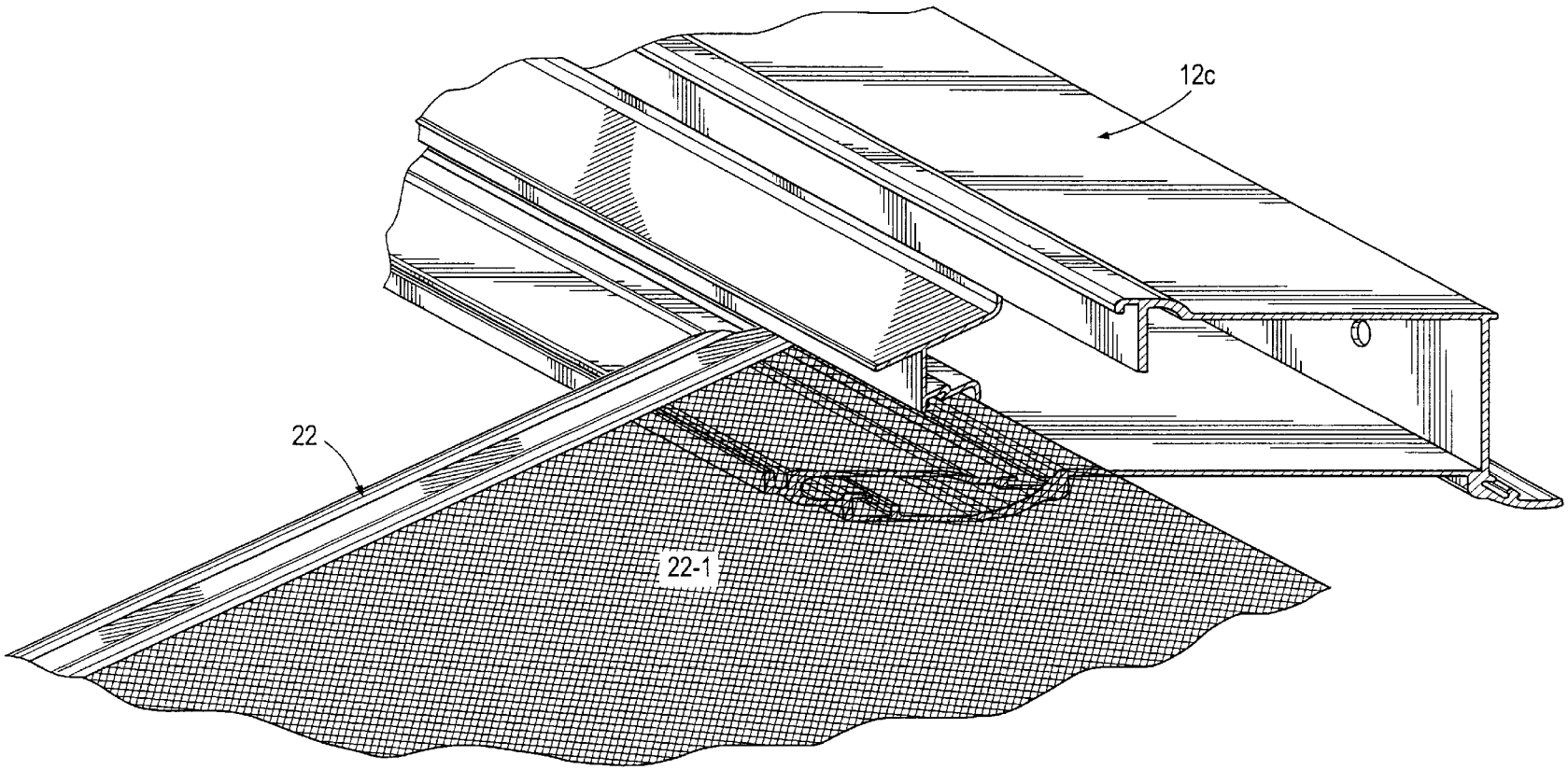

FIGS. 6A, B and C taken together illustrate screen fabric or cloth 22-1 slidably engaging track 54-1, similarly 54-2, located in each of the jambs 12*b, c* and which extend axially along the jamb. The end attachment feature 22 also slidably engages the track or slot 54-1, -2 on each of the jambs 12*b, c*.

Though the screen cloth or material 22-1 may be forced out of the respective tracks 54-1, -2 in each of jambs by a laterally directed force, the screen attachment member 22 will continue to remain in each of the tracks. This is facilitated by the shape of the attachment member 22 which includes an end region 23 which extends into the respective slot 54-1, -2.

In this instance, assuming that the screen cloth 22-1 has been forced from the respective track 54-1, the upper insert 14*c* can be moved to its fully closed position adjacent to header 12*a* to retract the screen onto the screen roll 28. In this circumstance, the attachment feature 22 is properly aligned to re-enter the tracks 54-1. As the insert 14*c* is moved away from the header 12*a*, it will pull the attachment member 22 with it. The ends 23 of the attachment member 22 will enter the respective slots 54-1 pulling the screen cloth 22-1 with them and retracking the screen. Alternately, the attachment member 22 can exhibit a retracted condition, adjacent to the screen module 20 while continuing to remain in the tracks 54-1.

Thus, as described above, if a force is exerted against the screen material 22-1 to pull it out of the side tracks 54-1 in each jamb, it is only necessary to reclose the insert 14*c* to rewind the screen material 22-1 into a proper configuration so that it will be immediately re-extendable into the slots or tracks 54-1.

FIGS. 7A, 7B and 7C illustrate additional details of the screen module 20. The module 20 is supported adjacent to the header 12*a* by brackets 30-1, -2. Module 20 can be removably attached to the header, the sill or the jambs. The module 20 is removable from the brackets 30-1, -2 for maintenance and/or replacement once the cover 24 has been removed from the respective door.

Figure 8:
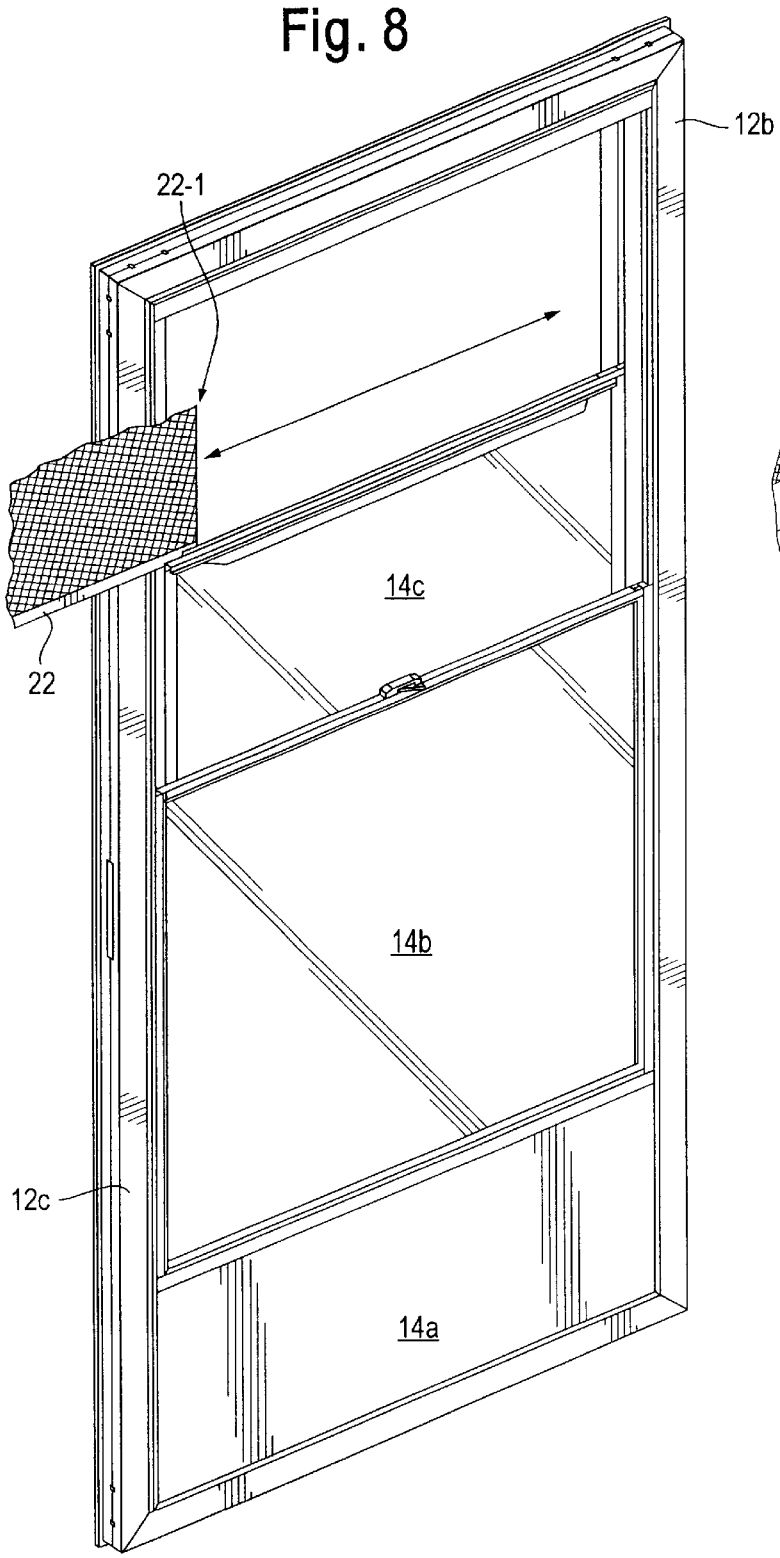
FIG. 8 is a rear isometric view of the door of FIG. 1A illustrating aspects of removing and replacing the screen module.
Figure 9:
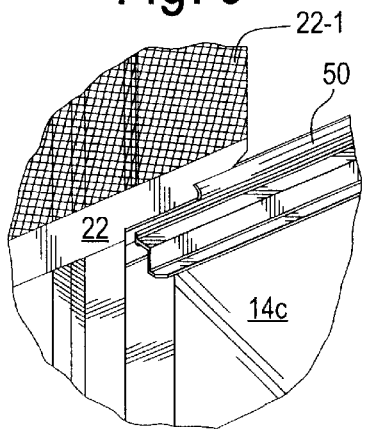
FIG. 9 is an enlarged region of a portion of FIG. 8 illustrating additional details thereof.

FIG. 8 illustrates additional details of removing and replacing the module 20. The connecting member 22 can be slid from the retaining feature 50 of the insert 14*c* as illustrated in FIGS. 8 and 9. When so-slid from the retaining feature 50, the entire module 20 can be replaced. Replacement involves attaching the connecting member of the new module to the attachment feature 50 by reversing the process illustrated in FIGS. 8 and 9. The screen roll 28 and screen fabric 22-1 can then be reattached brackets such as brackets 30-1, -2 in the header of the respective door. The cover 24 can be replaced. Moving the insert 14*c* vertically toward and away from the header will cause the screen fabric 22-1 of the replacement module to retract and extend as expected.

Figure 10:
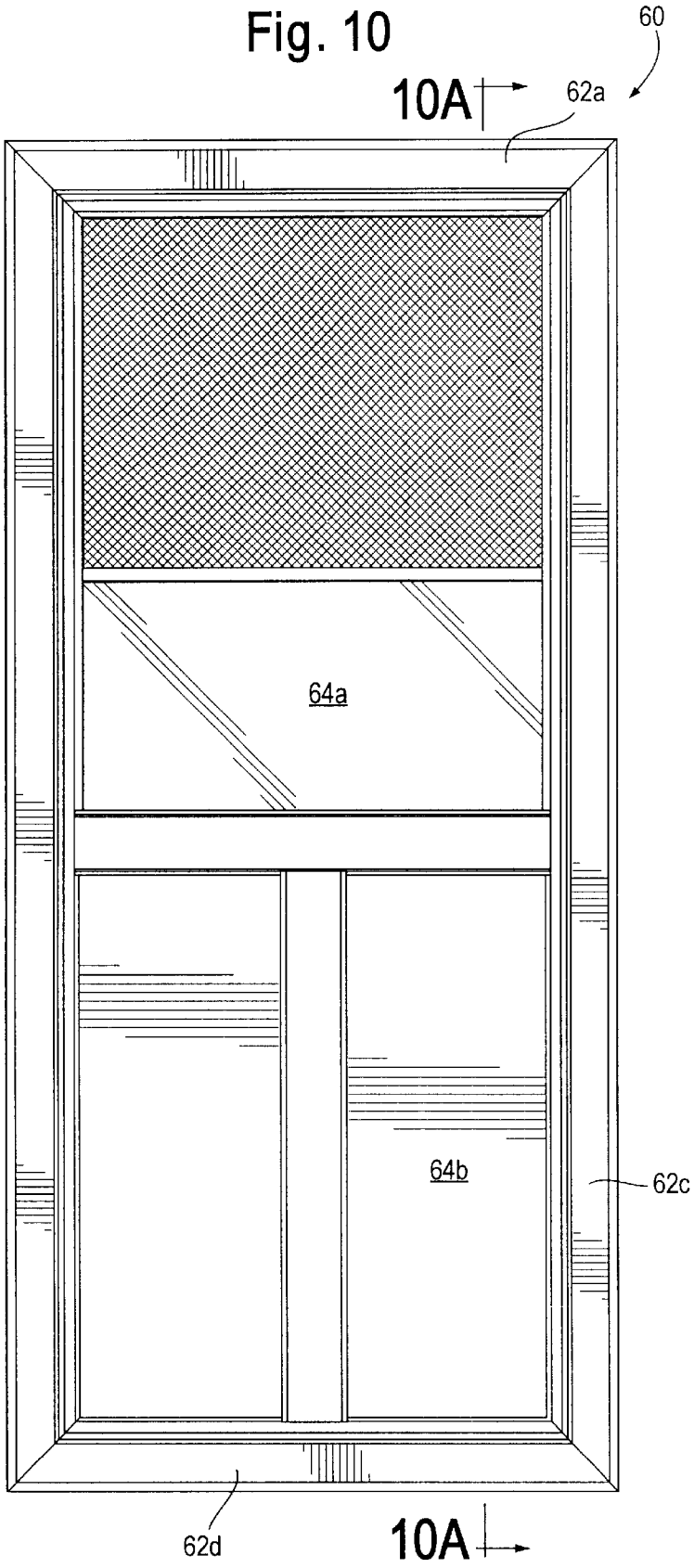
FIG. 10 is a front elevational view of another door which embodies the invention.
Figure 10A:
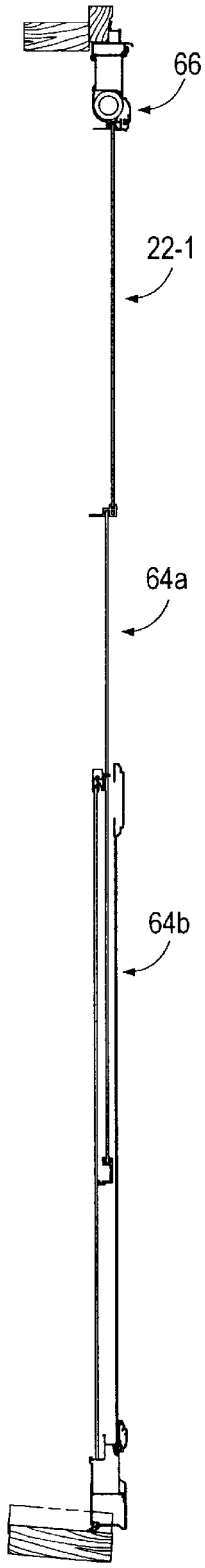
FIG. 10A is a side section of the door of FIG. 10 taken along plane 10A—10A.
Figure 11A:
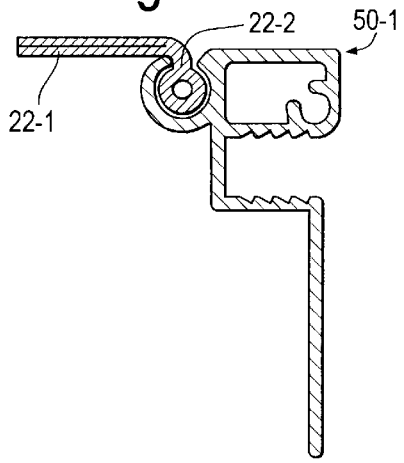
FIG.11 illustrates an end sectional view of a plurality of alternate mechanisms for coupling a retractable screen to a movable door insert.
Figure 11D:
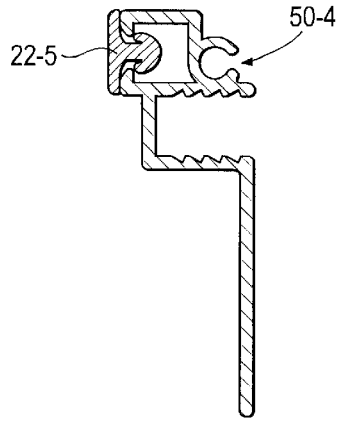
Figure 11B:
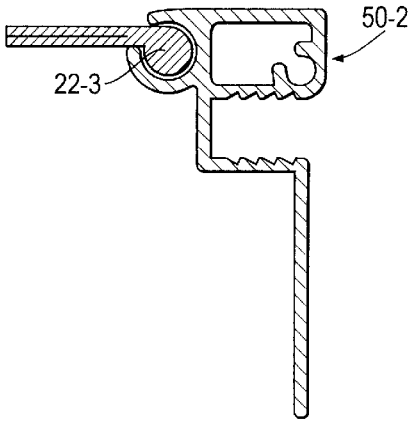
Figure 11E:
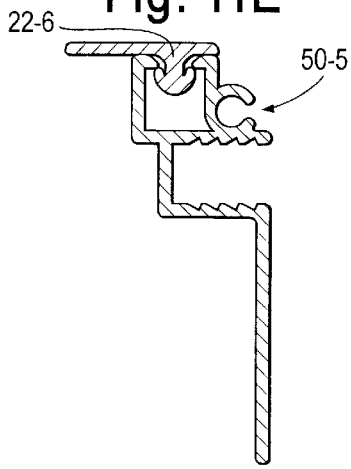
Figure 11C:
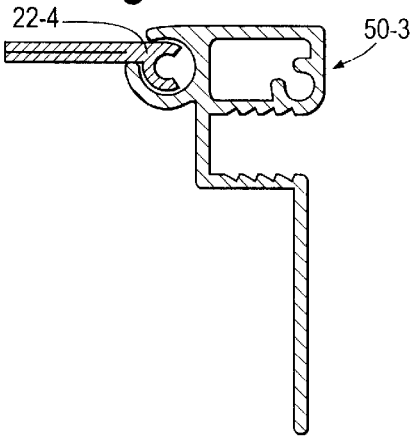
Figure 11F:
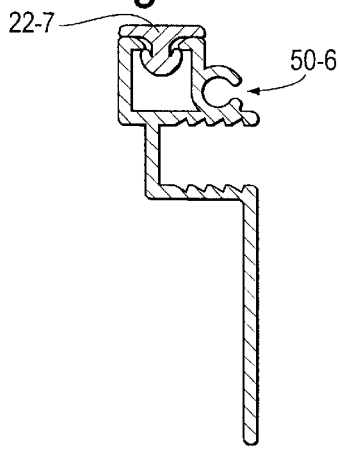

FIGS. 10, 10A and 10B illustrate a door 60 which has a header 62*a*, jambs 62*b, c* and a sill 62*d*. The door 60 includes insert 64*a* which is movable vertically toward the header 62*a* and away therefrom toward the sill 62*d*. The insert 64*a* can be supported by counterbalances, latches or frictional forces as discussed above relative to the door 10.

The door 60 carries a screen module 66, best illustrated in FIG. 10A. A free end of the screen of the screen module 66 is coupled to an upper end of insert 64*a* as discussed above.

A lower panel 64*b* of the door 60 is hollow and contains a space into which the insert 64*a* can be stored as it is moved downwardly toward the sill 62*d*. In this configuration, where the insert 64*a* is partly open, a portion of the screen 66*a* extends from the screen module 66 and fills the open space between jambs 62*b, c* and header 62*a*. The remainder of the space between the jambs 62*b, c* is filled by a portion of the insert 64*a* and the panel 64*b*. Thus, the door 60 provides convenient out of sight storage for the insert 64*a*.

FIG. 11 illustrates a plurality of alternate coupling members 50-1 . . . 50-6 that could be carried on the movable insert or pane, such as the insert 14*c*, and couplable to a free end of the screen fabric 22-1. As illustrated in FIG. 11, in each instance, the free end of the screen 22-1 would include a coupling element, such as 22-2 . . . 22-7 which would slidably engage the respective coupling member 50-1 . . . 50-6.

It will be understood that other arrangements can be used to attach a free end of the screen member 22-1 to a moving insert or pane. Alternates or include a spline which would trap the free end of the screen fabric 22-1 in contact with the movable inserts such as 14*c* clamps or adhesives. Other variations come within the spirit and scope of the invention.

Figure 12A:
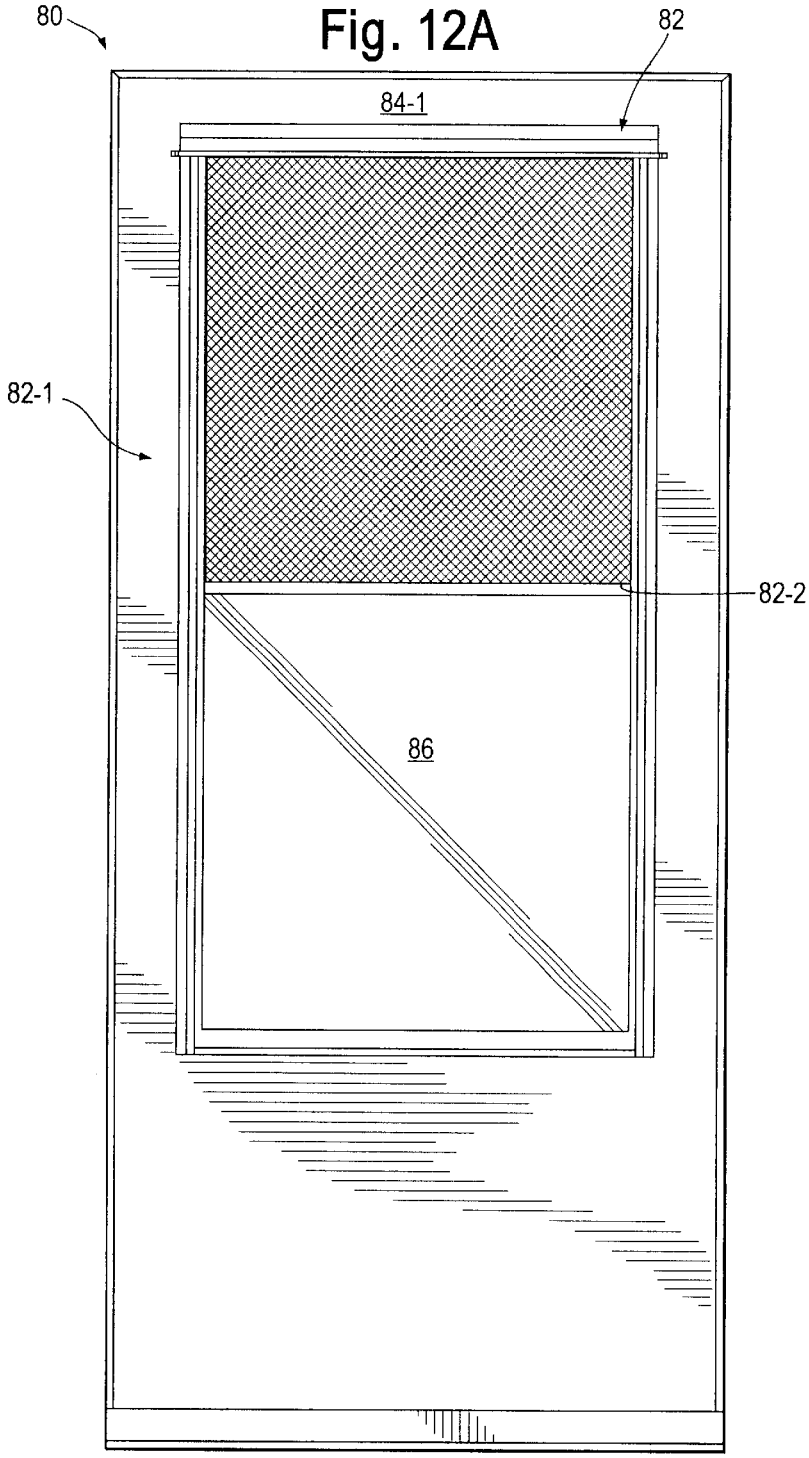
FIG. 12 is a rear elevational view of another door in accordance with the present invention.
Figure 12B:
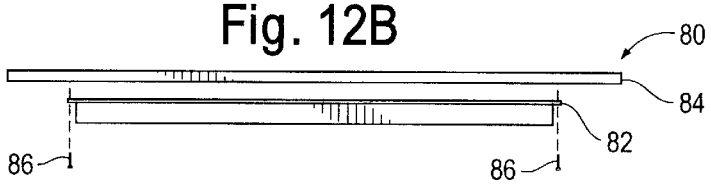

FIG. 12 illustrates a door 80 which incorporates a screen module 82, of the type discussed previously, which can be attached to door 84 as an after the fact accessory or add-on.

The module screen 82 can be attached to the door 84 by fasteners 86 in the vicinity of the header 84-1 of the door.

The screen fabric 82-1 can be pulled from the module 82 to close an opening in the door created by moving insert 86 downwardly away from the module 82. A free end 82-2 of the screen material 82-1 is attached to the sash or insert 86. Attachment can be effected by any of the previously discussed methods including using a spline, adhesive, providing attachment clips which slidably engage a portion of the sash of the insert 86. Other attachment vehicles can be used to connect the free end 82-2 to an upper end of the insert or sash 86 without departing from the spirit and scope of the present invention.

As the sash or insert 86 is moved toward the screen module 82, the fabric 82-1 rollably retracts into the module 82 as a result of the internal spring mechanism, discussed above, in connection with door 10. The screen material 82-1, also as discussed above, is under a constant pulling force due to the spring biasing mechanism of the module 82 which continually attempts to retract the fabric 82-1 into the module 82. Thus, as the sash or insert 86 moves toward the module 82, the screen material 82-1 is immediately rolled into the module 82 for out of the way storage.

It will also be understood that a resin or plastic sheet could be used as an alternate to screen fabric 82-1 without departing from the spirit and scope of the present invention. Thus, the screen module 82 provides a mechanism for adding to any existing door, after installation, a retractable screen feature such that existing screen panels or inserts in the door can be removed. This improves convenience and visibility in that with the sash or insert 86 closed, the screen fabric 82-1 is completely retracted and an individual looking at the door looks directly through the glass inserts or sashes without having to look through a screen.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A door comprising:

first and second spaced apart jambs wherein each jamb carries an axially oriented insert track, an adjacent axially oriented fabric track, and an axially oriented fabric edge retainer;

a spring biased roll of sheet material rotatably carried at one end of the jambs wherein the sheet material is removable from the roll and extends axially along at least part of the jambs with the edges of the sheet material located in respective fabric tracks engaged with respective edge retainers;

wherein the edge retainers each include at least one elongated weather stripping element wherein an edge region of the sheet material slidably engages the weather stripping element; and wherein the edge retainers each include a second elongated, different weather stripping element spaced from the one weather stripping element wherein an edge region of the sheet material extends laterally between the weather stripping elements.

2. A door as in claim 1 which includes an insert slidably movable in the insert tracks toward and away from respective ends of the jambs wherein the insert is coupled to the sheet material.

3. A door as in claim 2 which includes one of a counterbalance, a latch or friction between the insert and the respective jambs, for slidably supporting the insert at each of a plurality of axially displaced locations along the jambs.

4. A door as in claim 1 which includes one of a counterbalance, a latch or friction between the insert and the respective jambs, for slidably supporting the insert at each of a plurality of axially displaced locations along the jambs.

5. A door as in claim 1 wherein a free end of the sheet material is attached to a sash slidably mounted between the jambs.

6. A door as in claim 5 wherein the free end of the sheet material carries a coupling element which engages a coupling feature of the sash.

7. A door comprising:

first and second spaced apart jambs wherein each jamb carries an axially oriented insert track, an adjacent axially oriented fabric track, and an axially oriented fabric edge retainer;

a spring biased roll of sheet material rotatably carried at one end of the jambs wherein the sheet material is removable from the roll and extends axially along at least part of the jambs with the edges of the sheet material located in respective fabric tracks engaged with respective edge retainers;

wherein a free end of the sheet material is attached to a sash slidably mounted between the jambs; and wherein the edge retainers each include first and second different strips of weather stripping with one strip having first and second planar sections attached to one another at a selected angle.

8. A door as in claim 7 configured with a portion of the one strip exhibiting an angle in a range of fifteen to seventy-five degrees relative to the extended sheet material.

9. A door as in claim 1 wherein each edge retainer is positioned in a respective fabric track and each includes spaced apart, weather stripping with an edge of the sheet material slidable therebetween.

10. A door as in claim 9 wherein the sheet material has a free end which carries an elongated insert attachment member, L-shaped at least in part, and slidably engageable with an insert.

11. A door as in claim 10 wherein at least part of the insert attachment member has first and second spaced apart ends which extend into and slide between the weather stripping in each fabric track.

12. A door as in claim 11 wherein the sheet material slidably extends between weather stripping, and, if deflected so as to slide out from between the weather stripping, the sheet material can be rotated onto the roll and then re-extended between the weather stripping, by movement of the insert attachment member toward and then away from the roll.

13. A door as in claim 11 wherein the insert attachment member comprises, at least in part, metal or resin.

14. A door comprising:

first and second spaced apart jambs, the jambs are connected at one end by a header and at the other end by a sill wherein each jamb carries an axially oriented insert track, and an axially oriented fabric track;

elongated, facing, weather stripping located in each fabric track wherein first and second portions of the weather stripping face one another;

a screen module coupled to the header, the screen module carries a retractable screen having a selected width and having a free end wherein the free end is attached to an elongated feed assembly that extends at least across the width of the screen and which carries an elongated L-shaped connector element;

an insert carried in and movable in the insert tracks wherein the insert is positionable at a plurality of locations along the jambs and wherein the connector element slidably engages an elongated section of the insert whereby as the insert moves toward the sill the screen is extracted from the module and edges of the screen and ends of the elongated feed assembly slide in the fabric tracks between facing weather stripping portions with the screen retracting into the module as the insert moves toward the header.

15. A door as in claim 14 wherein the connector element is formed, at least in part, of one of metal or resin.

16. A door as in claim 15 wherein parts of the feed assembly and the connector element are integrally formed.

17. A door as in claim 15 including an elongated plastic body attached to the free end wherein the plastic body has ends that extend between the weather stripping in the fabric tracks.

18. A door as in claim 14 wherein in response to an applied lateral force, the screen deflects laterally relative to the jambs, withdrawing, at least in the deflected region, from the fabric tracks and, in the absence of that force, responsive to moving the insert adjacent to the module, the edges of the screen are positioned for re-entry to the fabric tracks, between the weather stripping, as the insert moves toward the sill.

19. A door as in claim 14 which carries one of insert latching elements, or, insert counterbalancing elements for positioning the insert at the plurality of locations.

20. A door an in claim 18 which carries one of insert latching elements, or, insert counterbalancing elements for positioning the insert at the plurality of locations.

21. A door comprising:

first and second spaced apart jambs joined by a header and a sill to bound an internal region, each of the jambs carries an insert track and an adjacent generally U-shaped screen track, the insert tracks open toward one another, the screen tracks open toward one another, the screen tracks each carry elongated weather stripping at least some of which extends toward the adjacent insert track; a glass insert, slidable in the insert track toward and away from the header, the insert has an end, closest to the header, which extends between the jambs with an elongated connection region formed on the end and the insert carries latches for engaging the jambs in a plurality of spaced apart locations; a screen module carried adjacent to the header wherein the module includes a biased roll of screen having a free end with the screen and the free end extending between the jambs and the weather stripping in the screen tracks, the free end carrying an elongated engagement feature including an L-shaped member for slidably engaging the elongated connection region formed on the end of the insert such that as the insert moves toward the sill, the screen is extracted from the roll and slides in the screen track between weather stripping with part of the engagement feature extending into the screen tracks, between the weather stripping, and as the insert is moved toward the header, the screen retracts into the module and wherein ends of the engagement feature are located adjacent to at least part of the screen track, when the screen is fully retracted.

22. A door as in claim 21 wherein the L-shaped member comprises one of resin or metal.

* * * * *

US006618998C1

(12) EX PARTE REEXAMINATION CERTIFICATE (5524th)

United States Patent

Thomas et al.

(10) Number: US 6,618,998 C1

(45) Certificate Issued: Sep. 19, 2006

(54) DOOR WITH VARIABLE LENGTH SCREEN

(75) Inventors: Bruce E. Thomas, Brookings, SD (US); Kelly D. Nordgaard, Gary, SD (US); Bryan P. Zacher, Brookings, SD (US); Alan M. Dixon, Brookings, SD (US); Allen E. Lee, Brookings, SD (US)

(73) Assignee: Larson Manufacturing Company, Brookings, SD (US)

Reexamination Request:
No. 90/007,223, Sep. 28, 2004

Reexamination Certificate for:

| | |
|---|---|
| Patent No.: | **6,618,998** |
| Issued: | **Sep. 16, 2003** |
| Appl. No.: | **10/212,465** |
| Filed: | **Aug. 5, 2002** |

Related U.S. Application Data

(60) Provisional application No. 60/310,557, filed on Aug. 7, 2001.

(51) Int. Cl.
*E06B 9/52* (2006.01)

(52) U.S. Cl. ..... 52/63; 52/455; 160/100

(58) Field of Classification Search ..... 52/63, 52/455; 160/27, 28, 99, 100
See application file for complete search history.

(56) References Cited

U.S. PATENT DOCUMENTS

| | | | | |
|---|---|---|---|---|
| 1,038,138 | A | * | 9/1912 | Hikes ..... 160/100 |
| 1,155,546 | A | | 10/1915 | Bridges |
| 1,168,155 | A | | 1/1916 | Broune |
| 1,172,800 | A | | 2/1916 | Johnson |
| 1,184,305 | A | | 5/1916 | Benko |
| 1,192,406 | A | | 7/1916 | Fair |
| 1,207,885 | A | | 12/1916 | Estabrook |
| 1,217,338 | A | | 2/1917 | Okamuro |
| 1,219,817 | A | | 3/1917 | Gemeny et al. |
| 1,240,768 | A | | 9/1917 | O'Neill |
| 1,241,425 | A | | 9/1917 | Nelson |
| 1,283,918 | A | | 11/1918 | Romuender |
| 1,317,579 | A | | 9/1919 | Johnson |
| 1,338,223 | A | | 4/1920 | Heath |
| 1,349,438 | A | | 8/1920 | Samplawski |
| 1,355,608 | A | | 10/1920 | Knapp |
| 1,370,500 | A | | 3/1921 | Jones |
| 1,414,583 | A | | 5/1922 | Rothstein |

(Continued)

FOREIGN PATENT DOCUMENTS

| | | | |
|---|---|---|---|
| AU | 351167 | | 6/1931 |
| AU | 121261 | | 3/1946 |
| DE | 60596 | | 1/1891 |
| DE | 264173 | | 9/1912 |
| DE | 2934122 | A1 | 3/1981 |
| DE | 2934122 | | 3/1981 |
| DE | 3639077 | A1 | 3/1988 |
| DE | 3639077 | | 3/1988 |
| DE | 19708816 | | 6/1997 |
| DE | 19708816 | A1 | 11/1997 |
| DE | 19825445 | | 12/1999 |
| DE | 19825445 | A1 | 12/1999 |
| GB | 153448 | | 11/1920 |

OTHER PUBLICATIONS

Reddiplex Group PLC, *Meshlock* data sheet, prior to Aug. 5, 2002, England.

Phantom MFG., *Design Specifications Retractable Screens*, Published Nov. 1999, Canada.

Eclipse Technologies, *Eclipse Retractable Screens*, prior to Aug. 5, 2002, Canada.

(Continued)

*Primary Examiner*—Jimmy G. Foster

(57) ABSTRACT

An exterior door incorporates at least one moving glass insert or sash slidable in first and second spaced apart tracks. An end of the insert is coupled to an end of a spring biased rolled screen. As the insert moves from the roll, the screen is extracted therefrom providing a continuously variable screened region in the door. The insert can be positioned using a counterbalance or spaced apart latchable locations in the door.

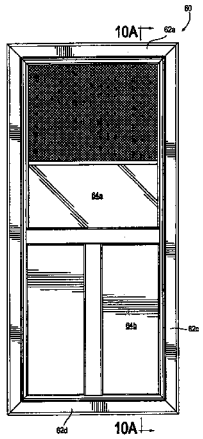

U.S. PATENT DOCUMENTS

| | | | |
|---|---|---|---|
| 1,459,155 | A | 6/1923 | Ioor |
| 1,462,644 | A | 7/1923 | Lancaster |
| 1,481,615 | A | 1/1924 | Meyer |
| 1,487,926 | A | 3/1924 | Evans |
| 1,583,133 | A | 5/1926 | Fierman |
| 1,662,117 | A | 3/1928 | Kuhl |
| 1,734,415 | A | 11/1929 | Bierfield |
| 1,810,849 | A | 6/1931 | Nye |
| 1,844,599 | A | 2/1932 | Renzetti |
| 1,859,883 | A | 5/1932 | Nordmarken |
| 1,863,255 | A | 6/1932 | Rogers |
| 1,866,788 | A | 7/1932 | Arthur |
| 1,871,141 | A | 8/1932 | Baker et al. |
| 1,873,156 | A | 8/1932 | Seide |
| 1,878,710 | A | 9/1932 | Watson |
| 1,880,589 | A | 10/1932 | Traut |
| 1,885,756 | A | 11/1932 | Norquist et al. |
| 1,934,103 | A | 11/1933 | Traut |
| 1,942,308 | A | 1/1934 | Renzetti |
| 1,958,695 | A | 5/1934 | Claus |
| 1,971,451 | A | 8/1934 | Helfmann |
| 1,987,488 | A | 1/1935 | Morelli |
| 1,996,108 | A | 4/1935 | Herr |
| 2,015,993 | A | 10/1935 | Drake |
| 2,107,755 | A | 2/1938 | Kemp |
| 2,131,521 | A | 9/1938 | Nye |
| 2,221,515 | A | 11/1940 | Goldenberg |
| 2,225,050 | A | 12/1940 | Herzog |
| 2,261,443 | A | 11/1941 | McGaw |
| 2,293,968 | A | 8/1942 | Chandler et al. |
| 2,336,530 | A | 12/1943 | Chandler et al. |
| 2,349,226 | A | 5/1944 | Thomas |
| 2,352,609 | A | 7/1944 | Bates |
| 2,365,454 | A | 12/1944 | Chandler et al. |
| 2,379,120 | A | 6/1945 | Turner |
| 2,386,016 | A | 10/1945 | Turner |
| 2,388,044 | A | 10/1945 | Drab |
| 2,428,644 | A | 10/1947 | Zega |
| 2,432,808 | A | 12/1947 | Royak |
| 2,509,398 | A | 5/1950 | Peremi et al. |
| 2,514,274 | A | 7/1950 | Zagrodny |
| 2,517,514 | A | 8/1950 | Walsh |
| 2,573,590 | A | 10/1951 | Mosebach |
| 2,575,128 | A | 11/1951 | Renzetti |
| 2,584,369 | A | 2/1952 | Renton |
| 2,615,513 | A | 10/1952 | Radford |
| 2,731,220 | A | 1/1956 | Power |
| 2,769,491 | A | 11/1956 | Pitcoff |
| 2,886,103 | A | 5/1959 | Pitcoff |
| 3,005,489 | A | 10/1961 | Crocker et al. |
| 3,024,837 | A | 3/1962 | McPhail |
| 3,105,542 | A | 10/1963 | Lynch |
| 3,116,097 | A | 12/1963 | Novales |
| 3,155,146 | A | 11/1964 | Malouf et al. |
| 3,173,474 | A | 3/1965 | Wootten |
| 3,179,161 | A | 4/1965 | Johnson |
| 3,244,222 | A | 4/1966 | Johnson |
| 3,398,779 | A | 8/1968 | Kuss |
| 3,414,039 | A | 12/1968 | King |
| 3,425,165 | A | 2/1969 | Cleveland |
| 3,448,943 | A | 6/1969 | Herou |
| 3,470,934 | A | 10/1969 | Agnew |
| 3,489,199 | A | 1/1970 | Weikel et al. |
| 3,489,200 | A | 1/1970 | Recchione |
| 3,552,471 | A | 1/1971 | Hurst et al. |
| 3,842,890 | A | 10/1974 | Kramer |
| 3,882,921 | A | 5/1975 | Sandall |
| 3,891,020 | A | 6/1975 | Mennuto |
| 3,911,990 | A | 10/1975 | Hoover et al. |
| 3,987,835 | A | 10/1976 | Bloomfield |
| 3,990,635 | A | 11/1976 | Restle et al. |
| 4,001,972 | A | 1/1977 | Hurwitz |
| 4,006,770 | A | 2/1977 | Ferguson |
| 4,009,745 | A | 3/1977 | Erpenbeck |
| 4,027,431 | A | 6/1977 | Rackard |
| 4,028,849 | A | 6/1977 | Anderson |
| 4,084,360 | A | 4/1978 | Reckson |
| 4,197,896 | A | 4/1980 | Reichstadt |
| 4,261,524 | A | 4/1981 | Lüdenbach |
| 4,267,876 | A | 5/1981 | Bloomfield |
| 4,297,812 | A | 11/1981 | McPhail |
| 4,311,183 | A | 1/1982 | Herbst et al. |
| 4,326,577 | A | 4/1982 | Tse |
| 4,344,255 | A | 8/1982 | Knoll |
| 4,345,636 | A | 8/1982 | Fukuchi |
| 4,357,978 | A | 11/1982 | Keller et al. |
| 4,359,081 | A | 11/1982 | Brower |
| 4,369,829 | A | 1/1983 | Casiday |
| 4,390,054 | A | 6/1983 | Niibori et al. |
| 4,418,739 | A | 12/1983 | Woolnough et al. |
| 4,458,739 | A | 7/1984 | Murray et al. |
| 4,467,853 | A | 8/1984 | Downey, Jr. |
| 4,472,862 | A | 9/1984 | Bloomfield et al. |
| 4,480,676 | A | 11/1984 | Solomon |
| 4,506,478 | A | 3/1985 | Anderson |
| 4,531,562 | A | 7/1985 | Swanson |
| 4,574,864 | A | 3/1986 | Tse |
| 4,586,291 | A | 5/1986 | Swan |
| 4,599,833 | A | 7/1986 | Bullock |
| 4,638,844 | A | 1/1987 | Hayashiguchi |
| 4,649,981 | A | 3/1987 | Bibeau |
| 4,651,797 | A | 3/1987 | Lange |
| 4,651,940 | A | 3/1987 | Nakamura |
| 4,658,879 | A | 4/1987 | Van Klompenburg |
| 4,667,441 | A | 5/1987 | Coddens |
| 4,671,557 | A | 6/1987 | Lemp |
| 4,685,175 | A | 8/1987 | Yonovich |
| 4,702,297 | A | 10/1987 | Van Klompenburg |
| 4,741,488 | A | 5/1988 | Futagawa |
| 4,757,852 | A | 7/1988 | Jentof et al. |
| 4,781,235 | A | 11/1988 | Hedstrom et al. |
| 4,819,295 | A | 4/1989 | Kaftan |
| 4,821,786 | A | 4/1989 | Johnston |
| 4,825,921 | A | 5/1989 | Rigter |
| 4,834,160 | A | 5/1989 | Becker |
| 4,846,241 | A | 7/1989 | Chomka et al. |
| 4,862,942 | A | 9/1989 | Johnson |
| 4,922,658 | A | 5/1990 | Coddens |
| 4,934,437 | A | 6/1990 | Kraeutler |
| 4,935,987 | A | 6/1990 | Sterner, Jr. |
| 4,961,247 | A | 10/1990 | Leitzel et al. |
| 4,987,943 | A | 1/1991 | Charest |
| 4,993,468 | A | 2/1991 | Hackman et al. |
| 4,999,948 | A | 3/1991 | Hodgens |
| 5,012,616 | A | 5/1991 | Martin |
| 5,015,034 | A | 5/1991 | Kindig et al. |
| 5,035,081 | A | 7/1991 | Yamamoto et al. |
| 5,039,246 | A | 8/1991 | Woodruff et al. |
| 5,044,417 | A | 9/1991 | Bresson |
| 5,092,388 | A | 3/1992 | Evers |
| 5,097,886 | A | 3/1992 | Moyet-Ortiz |
| 5,099,905 | A | 3/1992 | Rigter |
| 5,119,591 | A | 6/1992 | Sterner, Jr. et al. |
| 5,123,474 | A | 6/1992 | Smith |
| 5,265,308 | A | 11/1993 | May et al. |
| 5,351,738 | A | 10/1994 | Petersen et al. |
| 5,392,835 | A | 2/1995 | Wildt |
| 5,445,209 | A | 8/1995 | Lichy |
| 5,456,303 | A | 10/1995 | Horinouchi |
| 5,482,104 | A | 1/1996 | Lichy |
| 5,505,244 | A | 4/1996 | Thumann |

5,540,476 A 7/1996 Cowsert
5,544,689 A 8/1996 Wegner
5,634,508 A 6/1997 Herbst
5,651,406 A 7/1997 Schaap
5,671,790 A 9/1997 Andersen et al.
5,682,710 A 11/1997 Davies et al.
5,687,506 A 11/1997 Davies et al.
5,758,704 A 6/1998 Elrod
5,775,400 A 7/1998 Wilkinson
5,787,952 A 8/1998 Wegner
5,794,678 A 8/1998 Beringer et al.
5,802,971 A 9/1998 Hamu et al.
5,803,145 A 9/1998 Lamb
5,887,391 A 3/1999 Shoup
5,901,768 A 5/1999 Herbst
5,906,421 A 5/1999 Floyd
5,934,353 A 8/1999 Buhr
5,946,857 A 9/1999 Davies et al.
6,059,007 A 5/2000 Tomita
6,068,802 A 5/2000 Berghorn et al.
6,070,642 A 6/2000 Douglas et al.
6,082,432 A 7/2000 Kissinger
6,089,302 A 7/2000 Britt
6,116,321 A 9/2000 Kavchar
6,119,758 A 9/2000 Coenraets
6,167,936 B1 1/2001 Stover et al.
6,186,215 B1 2/2001 DeYoung et al.
6,209,610 B1 4/2001 Davies et al.
6,209,614 B1 4/2001 Smoot
6,256,931 B1 7/2001 Kenkel et al.
6,296,040 B1 10/2001 Schaap
6,378,594 B1 4/2002 Yamanaka et al.
6,405,781 B1 6/2002 Davies et al.
6,408,922 B1 6/2002 Desrochers
6,435,254 B1 8/2002 Todd et al.
6,446,696 B1 9/2002 Davies et al.
6,463,983 B1 10/2002 Lang
6,470,947 B1 10/2002 Holevas
6,478,070 B1 11/2002 Poppema
6,499,527 B1 12/2002 Lindley, Jr.
6,557,612 B1 5/2003 Schmidt
6,629,555 B1 10/2003 DeBlock et al.
6,640,869 B1 11/2003 Ralph et al.
6,679,002 B1 1/2004 Davies et al.
6,688,063 B1 2/2004 Lee et al.
6,691,761 B1 2/2004 Alkhoury et al.
6,701,994 B1 3/2004 Goldenberg et al.
6,712,404 B1 3/2004 Davies et al.

OTHER PUBLICATIONS

AGIgroup, *Screen–Time.com, Roll Screens*, copyright 1999–2000, United States of America.

EMCO Specialities, *Forever Storm & Screen Doors*, copyright 1998, United States of America.

Complaint for Patent Infringement, filed Oct. 24, 2003, U.S. District Court, District of South Dakota, Southern Division.

Answer and Counterclaim, filed Dec. 29, 2003, U.S. District Court, District of South Dakota, Southern Division.

Reply to Defendant's Counterclaims, filed Jan. 16, 2004, U.S. District Court, District of South Dakota, Southern Division.

Defendant's Amended Answer and Counterclaims, filed Apr. 29, 2004, U.S. District Court, District of South Dakota, Southern Division.

Reply to Defendants' Amended Counterclaims, filed May 14, 2004, U.S. District Court, District of South Dakota, Southern Division.

Verified Complaint for Patent Infringement, filed Aug. 4, 2004, U.S. District Court, District of South Dakota, Southern Division.

Answer and Counterclaim, filed Aug. 26, 2004, U.S. District Court, District of South Dakota, Southern Division.

Reply to Defendants' Counterclaim, filed Sep. 8, 2004, U.S. District Court, District of South Dakota, Southern Division.

Order, filed Oct. 4, 2004, U.S. District Court, District of South Dakota, Southern Division.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 14–19 is confirmed.

Claims 1–10 are cancelled.

Claims 11, 20 and 21 are determined to be patentable as amended.

Claims 12, 13 and 22, dependent on an amended claim, are determined to be patentable.

11. [A door as in claim 10] *A door comprising:*

*first and second spaced apart jambs wherein each jamb carries an axially oriented insert track, an adjacent axially oriented fabric track, and an axially oriented fabric edge retainer;*

*a spring biased roll of sheet material rotatably carried at one end of the jambs wherein the sheet material is removable from the roll and extends axially along at least part of the jambs with the edges of the sheet material located in respective fabric tracks engaged with respective edge retainers;*

*wherein the edge retainers each include at least one elongated weather stripping element wherein an edge region of the sheet material slidably engages the weather stripping element;*

*wherein the edge retainers each include a second elongated, different weather stripping element spaced from the one weather stripping element wherein an edge region of the sheet material extends laterally between the weather stripping elements;*

*wherein each edge retainer is positioned in a respective fabric track and each includes spaced apart, weather stripping with an edge of the sheet material slidable therebetween;*

*wherein the sheet material has a free end which carries an elongated insert attachment member, L-shaped at least in part, and slidably engageable with an insert; and* wherein at least part of the insert attachment member has first and second spaced apart ends which extend into and slide between the weather stripping in each fabric track.

20. A door [an] *as* in claim 18 which carries one of insert latching elements, or, insert counterbalancing elements for positioning the insert at the plurality of locations.

21. A door comprising:

first and second spaced apart jambs joined by a header and a sill to bound an internal region, each of the jambs carries an insert track and an adjacent generally U-shaped screen track, the insert tracks open toward one another, the screen tracks open toward one another, the screen tracks each carry elongated weather stripping at least some of which extends toward the adjacent insert track; a glass insert, slidable in the insert track toward and away from the header, the insert has an end, closest to the header, which extends between the jambs with an elongated connection region formed on the end and the insert carries latches for engaging the jambs in a plurality of spaced apart locations; a screen module carried adjacent to the header wherein the module includes a biased roll of screen having a free end with the screen and the free end extending between the jambs and the weather stripping in the screen tracks, the free end carrying an elongated engagement [feature] *member* including an L-shaped member for slidably engaging the elongated connection region formed on the end of the insert such that as the insert moves toward the sill, the screen is extracted from the roll and slides in the screen track between weather stripping with part of the engagement [feature] *member* extending into the screen tracks, between the weather stripping, and as the insert is moved toward the header, the screen retracts into the module and wherein ends of the engagement [feature] *member* are located adjacent to at least part of the screen track, when the screen is fully retracted.

* * * * *